US007270402B2

(12) United States Patent
Sakaida et al.

(10) Patent No.: US 7,270,402 B2
(45) **Date of Patent: *Sep. 18, 2007**

(54) INK JET HEAD AND INK JET PRINTER

(75) Inventors: Atsuo Sakaida, Gifu (JP); Yuji Shinkai, Handa (JP); Takeshi Asano, Nagoya (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 335 days.

This patent is subject to a terminal disclaimer.

(21) Appl. No.: 10/473,674

(22) PCT Filed: Feb. 19, 2003

(86) PCT No.: PCT/JP03/01809

§ 371 (c)(1),
(2), (4) Date: Nov. 18, 2004

(87) PCT Pub. No.: WO03/070470

PCT Pub. Date: Aug. 28, 2003

(65) Prior Publication Data

US 2004/0218018 A1 Nov. 4, 2004

(30) Foreign Application Priority Data

Feb. 19, 2002 (JP) ..... 2002-041296
Feb. 22, 2002 (JP) ..... 2002-046164
Sep. 26, 2002 (JP) ..... 2002-281139

(51) Int. Cl.
*B41J 2/045* (2006.01)

(52) U.S. Cl. ..... 347/68; 347/71

(58) Field of Classification Search ..... 347/68, 347/70–72; 29/25.35
See application file for complete search history.

(56) References Cited

U.S. PATENT DOCUMENTS 5,128,694 A * 7/1992 Kanayama ..... 347/72
5,402,159 A * 3/1995 Takahashi et al. ..... 347/9
5,912,526 A * 6/1999 Okawa et al. ..... 310/328
6,174,051 B1 * 1/2001 Sakaida ..... 347/72
6,431,691 B1 * 8/2002 Tanikawa et al. ..... 347/70
7,008,048 B2 * 3/2006 Sakaida ..... 347/68

FOREIGN PATENT DOCUMENTS

JP A-10-058675 3/1998
JP A 11-034341 2/1999
JP A 2002-127420 5/2002
WO WO 99/42292 A1 8/1999

* cited by examiner

*Primary Examiner*—An H. Do
(74) *Attorney, Agent, or Firm*—Oliff & Berridge, PLC

(57) ABSTRACT

An ink-jet head includes a passage unit including a plurality of pressure chambers, and a plurality of actuator units attached to a surface of the passage unit for changing the volume of each of the plurality of pressure chambers. The actuator unit has a layered structure laminated with four piezoelectric sheets to. In the actuator unit, individual electrodes are formed at positions respectively corresponding to each of the pressure chambers, only on a face of the uppermost piezoelectric sheet opposite to an attached face of the actuator unit to the passage unit. A common electrode kept at a constant potential is provided on a face of the uppermost piezoelectric sheet at the side facing the passage unit.

10 Claims, 24 Drawing Sheets

INK JET HEAD AND INK JET PRINTER

TECHNICAL FIELD

The invention relates to an ink-jet head for printing by ejecting ink onto a print medium, and an ink-jet printer including the ink-jet head.

BACKGROUND ART

In an ink-jet printer, an ink-jet head distributes ink supplied from an ink tank to pressure chambers. The ink-jet head selectively applies pulsed pressure to each pressure chamber to eject ink through a nozzle. As a means for selectively applying pressure to the pressure chambers, an actuator unit having laminated ceramic piezoelectric sheets may be used.

As an example, a generally-known ink-jet head has one actuator unit in which continuous flat piezoelectric sheets extending over a plurality of pressure chambers are laminated. At least one of the piezoelectric sheets is sandwiched by a common electrode and many individual electrodes, i.e., driving electrodes. The common electrode is common to the pressure chambers and is kept at the ground potential. The many individual electrodes, i.e., driving electrodes, are disposed at positions corresponding to the respective pressure chambers.

The part of piezoelectric sheet being sandwiched by the individual and common electrodes, and which is polarized in its thickness, acts, by applying an external electric field, as an active layer that deforms by piezoelectric effect. Therefore, when an individual electrode on one face of the sheet is set at a different potential from the potential of the common electrode on the other face, the active layers are expanded or contracted in its thickness direction by the so-called longitudinal piezoelectric effect. The volume of the corresponding pressure chamber thereby changes, so ink can be ejected toward a print medium through a nozzle communicating with the pressure chamber.

In the above-described ink-jet head, however, the individual electrodes are arranged on the plurality of laminated piezoelectric sheets. Accordingly, in order to manufacture this ink-jet head, a series of complicated steps are required to form through holes for connecting individual electrodes located at positions overlapping in a plan view, and burying a conductive material in the through holes.

Therefore, a primal objective of the invention is to provide an ink-jet head which does not require to form through holes for feeding driving signals to the individual electrodes in piezoelectric sheets, thereby improving its manufacturing process.

DISCLOSURE OF THE INVENTION

An ink-jet head of the invention includes a passage unit that includes a plurality of pressure chambers, each having one end connected with a nozzle and the other end to be connected with an ink supply source, the plurality of pressure chambers being arranged along a plane adjacent to each other; and a plurality of actuator units attached to a surface of the passage unit for changing the volume of each of the pressure chambers. Each actuator unit has a common electrode kept at a constant potential; individual electrodes disposed at positions respectively corresponding to the pressure chambers, the individual electrodes being formed only on a face of the actuator unit opposite to an attached face thereof to the passage unit; a piezoelectric sheet sandwiched between the common electrode and the individual electrodes; and an inactive layer sandwiched between the common electrode and the passage unit. According to another aspect of the invention, there is provided an ink-jet printer including the above-described ink-jet head.

With this configuration, no individual electrode is located in the actuator unit. Therefore, the ink-jet head can be manufactured without any of the complicated steps such as the step of forming the through holes for connecting the individual electrodes overlapping each other in a plan view.

In the invention, it is preferable that the actuator unit includes the piezoelectric sheet constituting an outermost layer of the actuator unit and formed with the common electrode, and the inactive layer having a thickness larger than that of the piezoelectric sheet.

With this configuration, the piezoelectric sheet having the active layers, and the inactive layer having a thickness larger than that of the above-mentioned piezoelectric sheet are laminated to compensate brittleness of the piezoelectric sheet, thereby improving handling ability of the actuator unit. This enables the ink-jet head to be easily manufactured without handling with any high accuracy.

In this case, the inactive layer may comprise a lamination of a plurality of insulating sheets.

With this configuration, decrease in voltage endurance of the active layers sandwiched between the individual electrodes and the common electrode and occurrence of short-circuit caused by ink penetrating into the piezoelectric sheet can be prevented, and therefore, occurrence of distribution of piezoelectric property depending on positions in the actuator unit is restrained. As a result, an ink-jet head having a uniform ink-ejecting property regardless of positions therein can be obtained.

In this case, moreover, the plurality of insulating sheets may have substantially the same thickness.

With this configuration, because there is no need to change a thickness according to each insulating sheets, control of the thickness of the inactive layer can easily be performed so as to simplify the manufacturing of the inactive layer.

In the invention, moreover, the inactive layer is preferably formed of one or more piezoelectric sheets.

With this configuration, since the inactive layer and one or more layers including the active layers can be made of the same material, a manufacturing process is simplified.

In the invention, further, the actuator unit may internally hold only the common electrode, among the common electrode and the individual electrodes.

With this configuration, a manufacturing process of the actuator unit can be simplified.

In the invention, still further, the actuator unit may be arranged across the plurality of pressure chambers.

With this configuration, a structure and manufacturing process of the ink-jet head can be simplified, as compared with the case of providing the independent actuator units corresponding to the respective pressure chambers.

In the invention, still further, the common electrode may be kept at the ground potential.

With this configuration, a structure for feeding power to the common electrode can be simplified.

In the invention, still further, the common electrode may be arranged in such a manner as to substantially cover the entire face of the piezoelectric sheet.

With this configuration, a strength of the piezoelectric sheet can be increased, thus to prevent damages caused in handling them, and then to improve handling ability of the actuator unit.

BEST MODE FOR CARRYING OUT THE INVENTION

EMBODIMENT 1

Hereinafter, preferred embodiments of the invention will be described with reference to the drawings.

Figure 1:
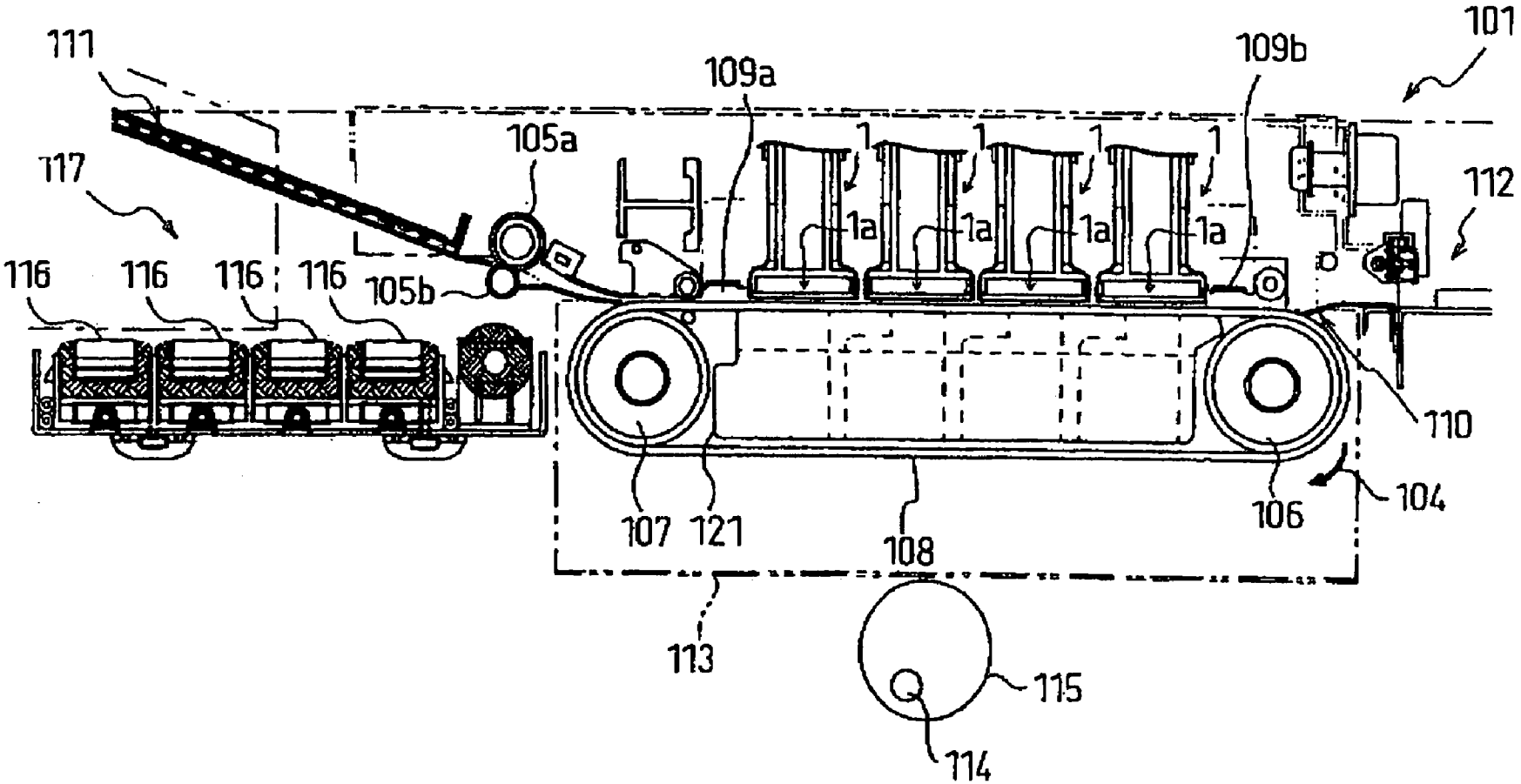
FIG. 1 is a schematic view of an ink-jet printer including ink-jet heads according to a first embodiment of the invention.

FIG. 1 is a schematic view of an ink-jet printer having ink-jet heads according to the first exemplary embodiment of the invention. As shown in FIG. 1, the ink-jet printer 101 is a color ink-jet printer having four ink-jet heads 1. In this printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* is disposed immediately downstream of the paper feed unit 111 for pinching and putting forward a paper as an image record medium. By the pair of feed rollers 105*a* and 105*b*, the paper is transferred from the left to the right in FIG. 1. In the middle of the paper transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone. Thus, a paper fed through the pair of feed rollers 105*a* and 105*b* can be held on the transfer face of the transfer belt 108 by the adhesion of the face. In this state, the paper is transferred downstream (rightward) by driving one belt roller 106 to rotate clockwise in FIG. 1 (the direction indicated by an arrow 104).

Pressing members 109*a* and 109*b* are disposed at positions for feeding a paper onto the belt roller 106 and taking out the paper from the belt roller 106, respectively. Either of the pressing members 109*a* and 109*b* can be used for pressing the paper onto the transfer face of the transfer belt 108 so as to prevent the paper from separating from the transfer face of the transfer belt 108. Thus, the paper securely adheres to the transfer face.

A peeling device 110 is provided immediately downstream of the transfer belt 108 along the paper transfer path. The peeling device 110 is constructed to peel off the paper, which has adhered to the transfer face of the transfer belt 108, from the transfer face to transfer the paper toward the rightward paper discharge unit 112.

Each of the four ink-jet heads 1 includes, at its lower end, a head main body 1*a*. Each head main body 1*a* has a rectangular section. The head main bodies 1*a* are arranged close to each other with the longitudinal axis of each head main body 1*a* being perpendicular to the paper transfer direction (perpendicular to FIG. 1). That is, this printer 101 is a line type. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively.

The head main bodies 1*a* are disposed such that a narrow clearance must be formed between the lower face of each head main body 1*a* and the transfer face of the transfer belt 108. The paper transfer path is formed within the clearance. In this construction, while a paper, which is being transferred by the transfer belt 108, passes immediately below the four head main bodies 1*a* in order, the respective color inks are ejected through the corresponding nozzles toward the upper face, i.e., the printing face, of the paper to form a desired color image on the paper.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a purge system (not shown).

During ink-jet printer 101 operation, the maintenance unit 117 is at a position immediately below the paper feed unit 111 (withdrawal position). When a predetermined condition is satisfied after finishing the printing operation, for example, when no printing operation takes place for a predetermined time period or when the printer 101 is powered off, the maintenance unit 117 moves to a position, known as cap position, immediately below the four head main bodies 1*a*, At this position, the maintenance unit 117 covers the lower faces of the head main bodies 1*a* with the respective caps 116 to prevent ink in the nozzles of the head main bodies 1*a* from becoming dry.

The belt rollers 106 and 107 and the transfer belt 108 are supported by a chassis 113, The chassis 113 is put on a cylindrical member 115 disposed under the chassis 113. The cylindrical member 115 is rotatable around a shaft 114 provided at a position which is off-center from the center of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must have been rotated at a predetermined angle in advance so as to move down the chassis 113, the transfer belt 108, and the belt rollers 106 and 107 by an applicable distance from the position illustrated in FIG. 1. A space for the movement of the maintenance unit 117 is thereby ensured.

In the region surrounded by the transfer belt 108, a nearly rectangular guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
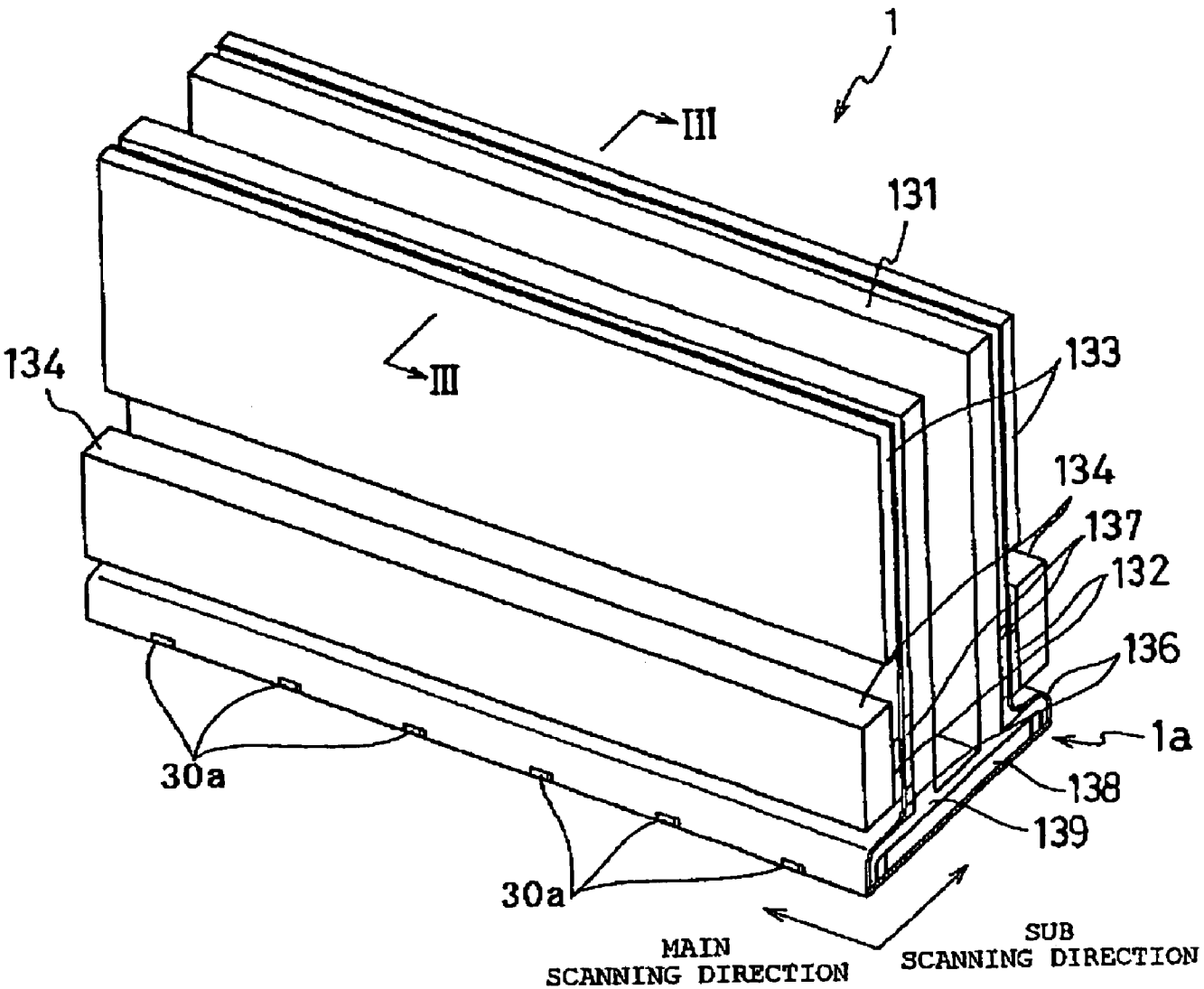
FIG. 2 is a perspective view of an ink-jet head according to the first embodiment of the invention.
Figure 3:
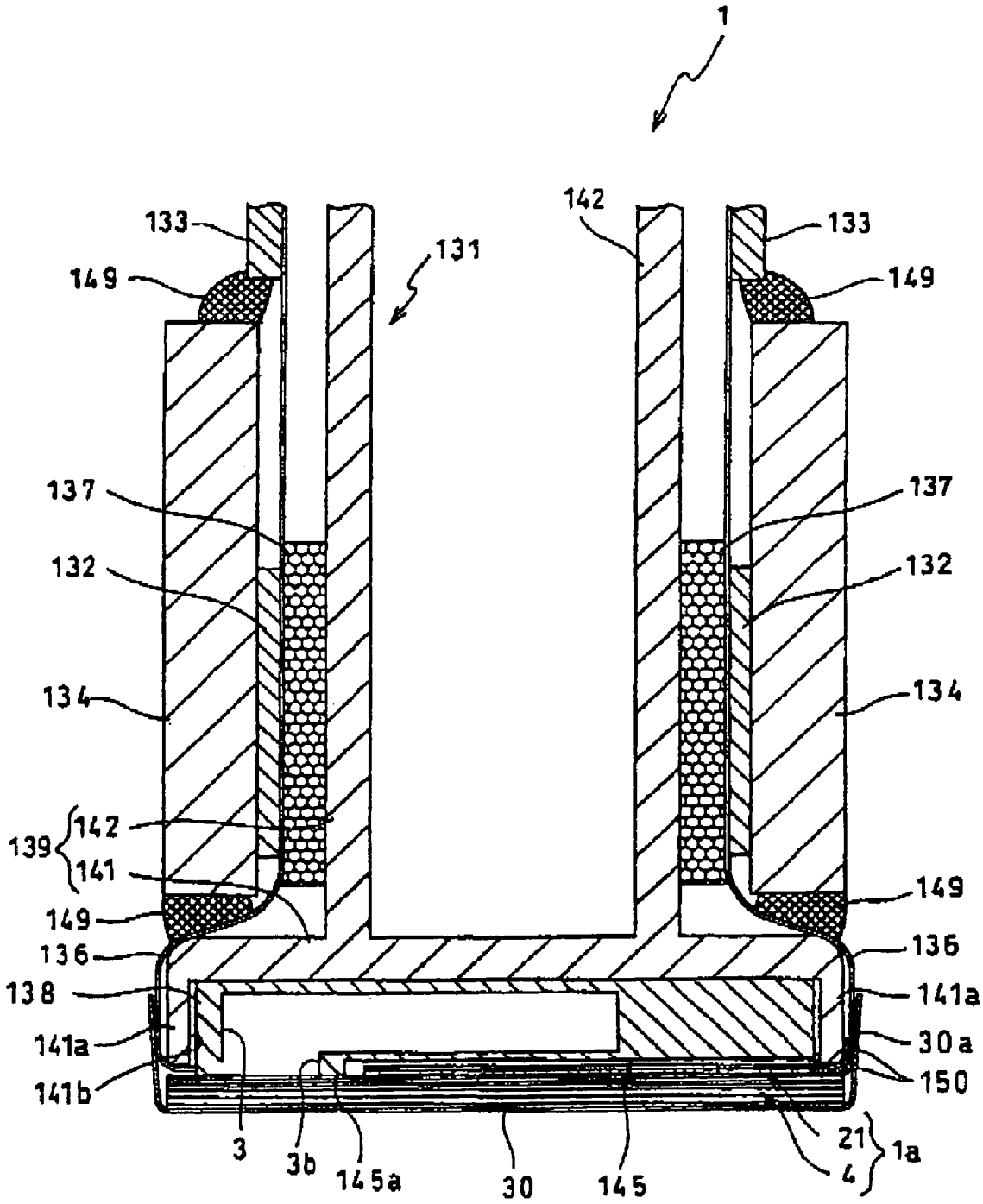
FIG. 3 is a sectional view taken along line III-III of FIG. 2.

Next, the structure of each ink-jet head 1 according to this embodiment will be described in more detail. FIG. 2 is a perspective view of the ink-jet head 1. FIG. 3 is a sectional view taken along line III-III in FIG. 2. Referring to FIGS. 2 and 3, the ink-jet head 1 according to this embodiment includes a head main body 1*a* having a rectangular shape in a plan view with its longest side extending in the main scanning direction, and a base portion 131 for supporting the head main body 1*a*. The base portion 131 supporting the head main body 1*a* further supports thereon driver ICs 132 for supplying driving signals to individual electrodes 35 (see FIG. 6), and substrates 133.

Referring to FIG. 2, the base portion 131 includes a base block 138 partially bonded to the upper face of the head main body 1*a* to support the head main body 1*a*, and a holder 139 bonded to the upper face of the base block 138 to support the base block 138. The base block 138 is a nearly rectangular member having substantially the same length of the head main body 1*a*. The base block 138 is made of metal-like material, such as stainless steel, and functions as a light structure for reinforcing the holder 139. The holder 139 includes a holder main body 141 disposed near the head main body 1*a*, and a pair of holder support portions 142, each of which extending on the opposite side of the holder main body 141 to the head main body 1*a*. Each holder support portion 142 is configured as a flat member. These holder support portions 142 extend along the longitudinal direction of the holder main body 141 and are disposed in parallel with each other at a predetermined interval.

Skirt portions 141*a* in a pair, protruding downward, are provided in both end portions of the holder main body 141*a* in a sub scanning direction (a direction perpendicular to the main scanning direction). Each skirt portion 141*a* is formed through the length of the holder main body 141. As a result, a nearly rectangular groove 141*b* is defined by the pair of skirt portions 141*a* in the lower portion of the holder main body 141. The base block 138 is positioned in the groove 141*b*. The upper surface of the base block 138 is adhered to the bottom of the groove 141*b* of the holder main body 141 with an adhesive. The thickness of the base block 138 is slightly larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular space or hollow region extending along the longitudinal direction of the base block 138. In the lower face 145 of the base block 138, openings 3*b* (see FIG. 4) are formed each communicating with the ink reservoir 3. The ink reservoir 3 is connected with a not-illustrated main ink tank or ink supply source (not shown) within the printer main body through a supply tube (not shown). Thus, the ink reservoir 3 is appropriately supplied with ink from the main ink tank.

In the lower face 145 of the base block 138, the surrounding area of each opening 3*b* protrudes downward from the surrounding portion. The base block 138 is contacted with a passage unit 4 (see FIG. 3) of the head main body 1*a* at the only vicinity portion 145*a* of each opening 3*b* of the lower face 145. Thus, the region of the lower face 145 of the base block 138 other than the vicinity portion 145*a* of each opening 3*b* is distant from the head main body 1*a*. Actuator units 21 are disposed within the distance.

On the outer side face of each holder support portion 142 of the holder 139, a driver IC 132 is attached with an elastic member 137, such as a sponge positioned between them. A heat sink 134 is disposed in close contact with the outer side face of the driver IC 132. The heat sink 134 is made of a nearly rectangular member for efficiently radiating heat generated in the driver IC 132. A flexible printed circuit (FPC) 136, acting as a power supply member, is connected to the driver IC 132. The FPC 136 connected to the driver IC 132 is adhered to, and electrically-connected with, the corresponding substrate 133 and the head main body 1*a* using solder. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is attached to the passage unit 4 and the holder main body 141 by using the seal member 150. Therefore, even if the head main body 1*a* is elongated, the head main body 1*a* can be prevented from bending, the interconnecting portion between each actuator unit 21 and the FPC 136 can be prevented from receiving stress, and the FPC 136 can be securely held in place.

Referring to FIG. 2, near each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIG. 7). The nozzle plate 30 is bent by about 90 degrees along the boundary line between each protruding portion 30*a* and the other portion. The protruding portions 30*a* are provided at positions corresponding to the vicinities of both ends of various sizes of papers to be used for printing in the printer 101. Each bent portion of the nozzle plate 30 has a rounded shape instead of making a right angle. This makes difficult the occurrence of a clogging with a paper, i.e., jamming, which is caused by a contact of a front end portion of a paper, fed in a direction approaching to the ink-jet head 1, with a side face of the ink-jet head 1.

Figure 4:
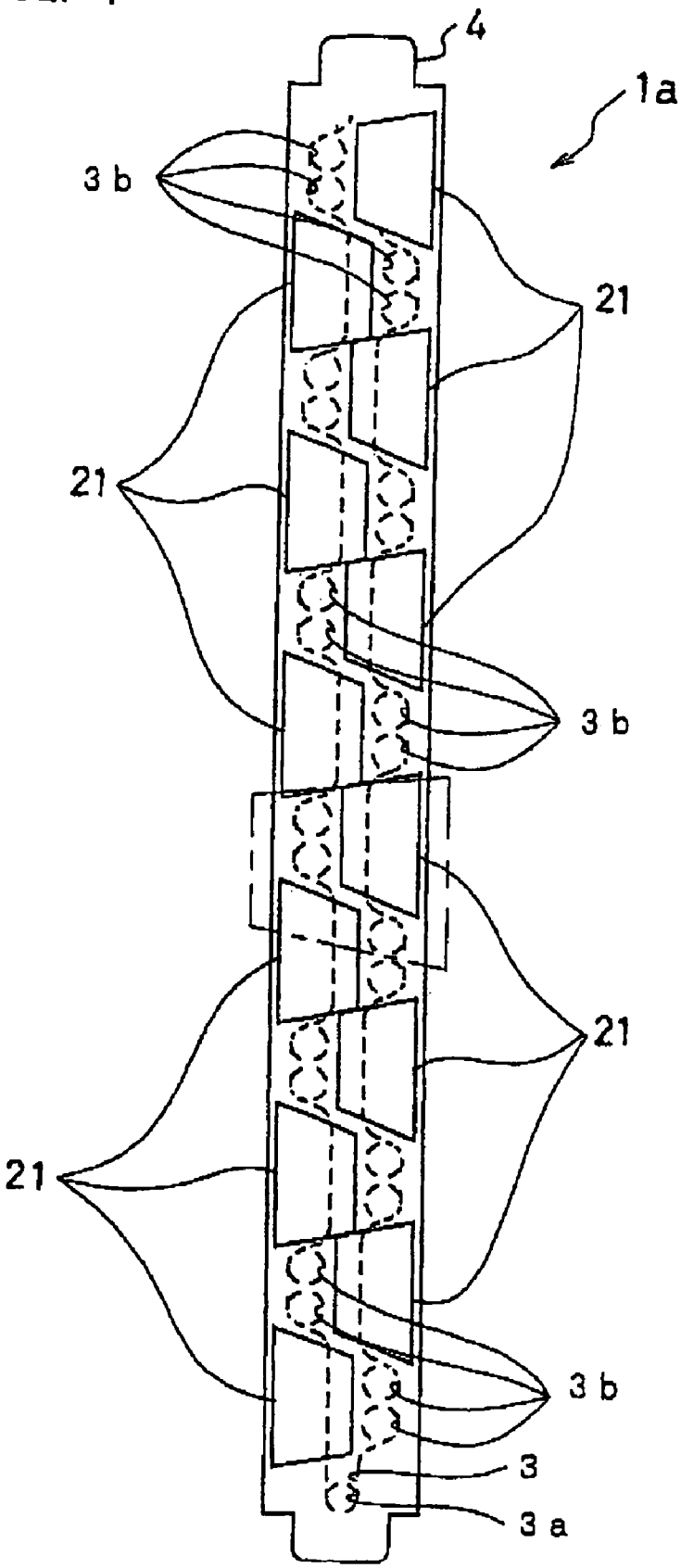
FIG. 4 is a plan view of a head main body included in the ink-jet head illustrated in FIG. 2.

FIG. 4 is a schematic plan view of the head main body 1*a*. In FIG. 4, an ink reservoir 3 formed in the base block 138 is conceptually illustrated with a broken line. Referring to FIG. 4, the head main body 1*a* has a rectangular shape in the plan view extending in a direction (the main scanning direction). The head main body 1*a* includes a passage unit 4, in which a large number of pressure chambers 10 and a large number of ink ejection ports 8 at the front ends of nozzles (as for both, see FIGS. 5, 6, and 7) are provided as described later. Trapezoidal actuator units 21 arranged in two lines in a zigzag manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not shown) through an opening 3*a* provided at one end of the ink reservoir 3, so that the ink reservoir 3 is always filled up with ink. In the ink reservoir 3, pairs of openings 3*b* are provided in regions where no actuator unit 21 is present, so as to be arranged in a zigzag manner along the longitudinal direction of the ink reservoir 3.

Figure 5:
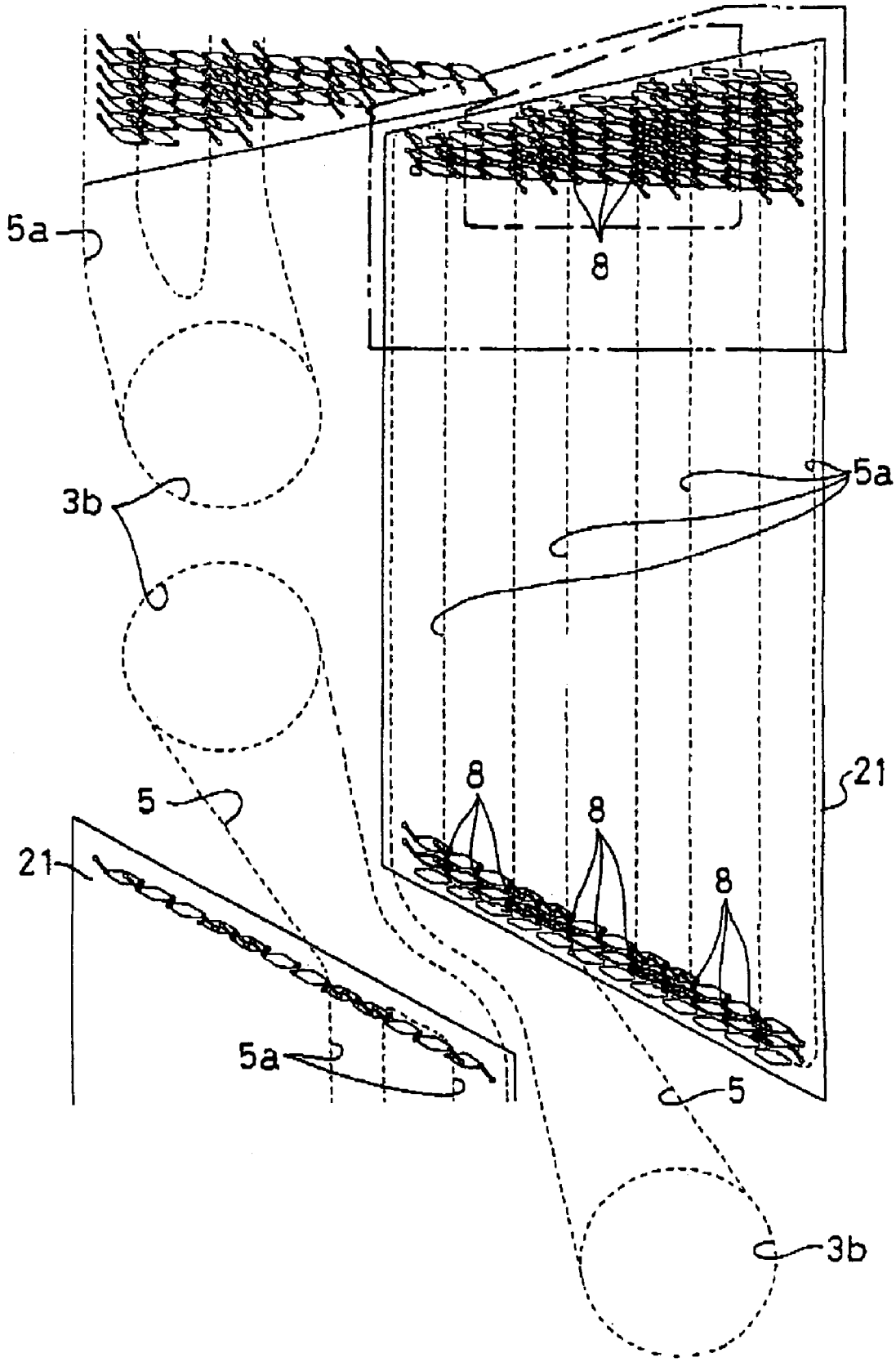
FIG. 5 is an enlarged view of the region enclosed by an alternate long and short dash line illustrated in FIG. 4.

FIG. 5 is an enlarged view of the region enclosed with an alternate long and short dash line in FIG. 4. Referring to FIGS. 4 and 5, the ink reservoir 3 communicates through openings 3*b* with a manifold channel 5 in the passage unit 4 disposed under the openings 3*b*. Each opening 3*b* is provided with a filter (not shown) for catching dust and dirt that may be contained in ink. The front end portion of each manifold channel 5 branches into two sub-manifold channels 5*a*. Below a single one of the actuator unit 21, two sub-manifold channels 5*a* extend from each of the two openings 3*b* on both sides of the actuator unit 21 in the longitudinal direction of the ink-jet head 1. That is, below the single actuator unit. 21, four sub-manifold channels 5*a* in total extend along the longitudinal direction of the ink-jet head 1. Each sub-manifold channel 5*a* is filled up with ink supplied from the ink reservoir 3.

Figure 6:
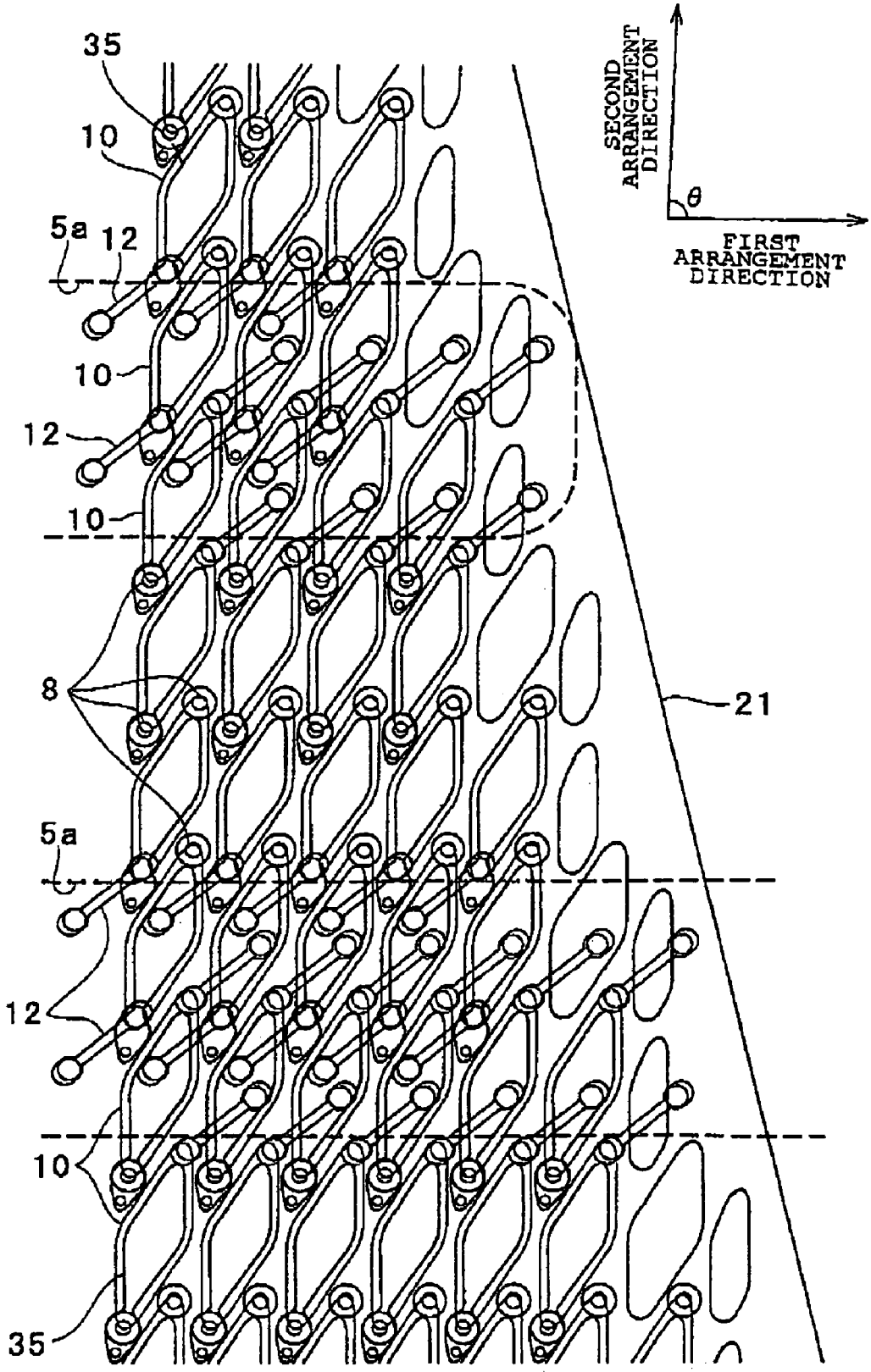
FIG. 6 is an enlarged view of the region enclosed by an alternate long and short dash line illustrated in FIG. 5.

FIG. 6 is an enlarged view of the region enclosed with an alternate long and short dash line in FIG. 5. Referring to FIGS. 5 and 6, on the upper face of each actuator unit 21, individual electrodes 35 having a nearly rhombic shape in a plan view are uniformly arranged in a matrix. A large number of ink ejection ports 8 are arranged in a matrix in the surface of the ink ejection region corresponding to the actuator unit 21 of the passage unit 4. In the passage unit 4, pressure chambers (cavities) 10 each having a nearly rhombic shape in a plan view somewhat larger than that of the individual electrodes 35 are uniformly arranged in a matrix. Further, in the passage unit 4, apertures 12 are also uniformly arranged in a matrix. These pressure chambers 10 and apertures 12 communicate with the corresponding ink ejection ports 8. The pressure chambers 10 are provided at positions corresponding to the respective individual electrodes 35. In a plan view, the large part of the individual electrode 35*a* is included in a region of the corresponding pressure chamber 10. In FIGS. 5 and 6, for ease in understanding the drawings, the pressure chambers 10, the apertures 12, etc., are illustrated with solid lines though they should be illustrated with broken lines because they are within the actuator unit 21 or the passage unit 4.

Figure 7:
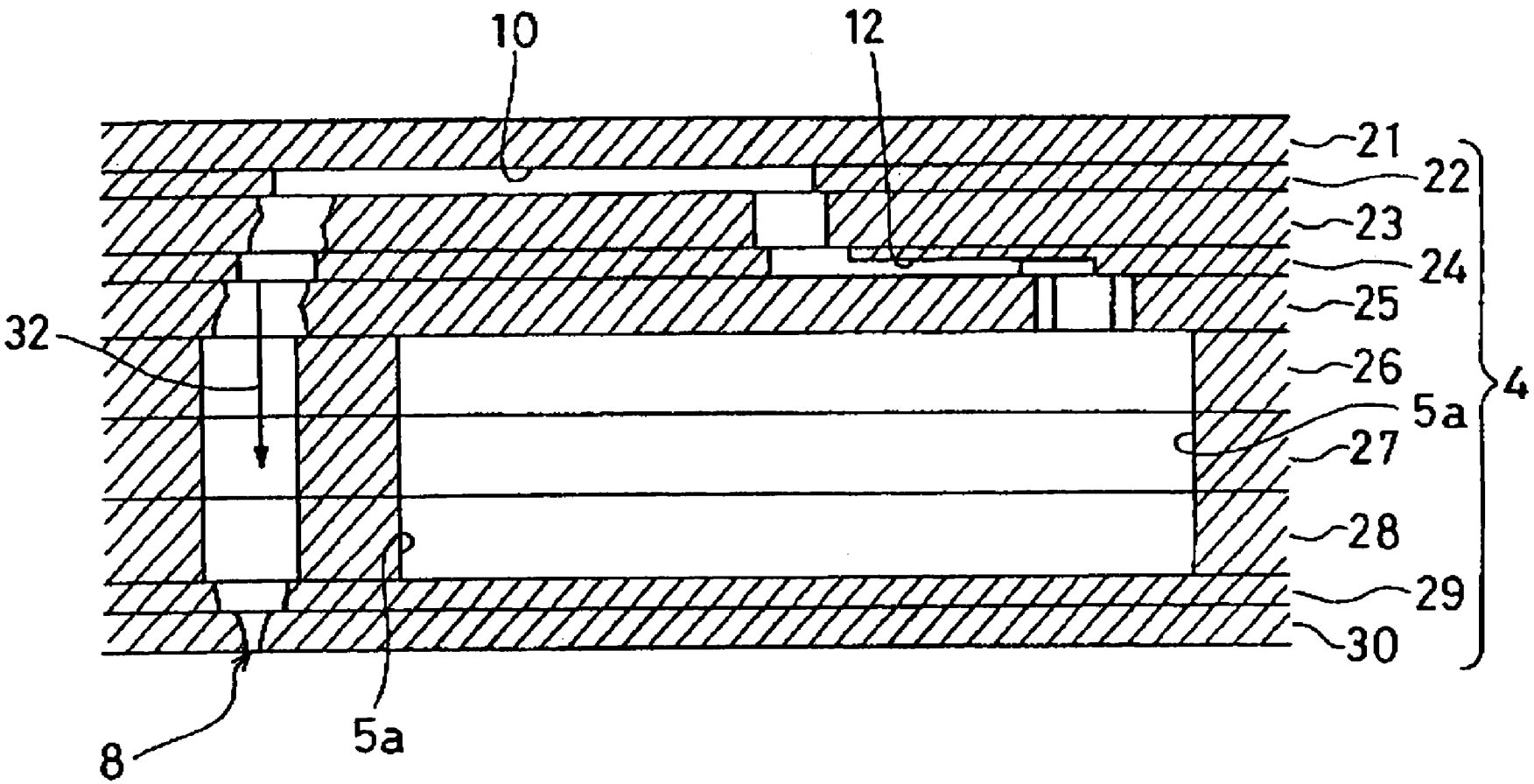
FIG. 7 is a partial sectional view of the ink-jet head main body illustrated in FIG. 4.

FIG. 7 is a partial sectional view of the head main body 1*a* of FIG, 4 along the longitudinal direction of a pressure chamber. As shown in FIG. 7, each ink ejection port 8 is formed at the front end of a tapered nozzle. Each ink ejection port 8 communicates with a sub-manifold channel 5*a* through a pressure chamber 10 (length: 900 microns, width: 350 microns) and an aperture 12. Thus, within the ink-jet head 1 formed are ink passages 32 each extending from an ink tank to an ink ejection port 8 through an ink reservoir 3, a manifold channel 5, a sub-manifold channel 5*a*, an aperture 12, and a pressure chamber 10.

Referring to FIG. 7, the pressure chamber 10 and the aperture 12 are provided at different levels. Therefore, as shown in FIG. 6, in the portion of the passage unit 4 corresponding to the ink ejection region under an actuator unit 21, an aperture 12 communicating with one pressure chamber 10 can be disposed within the same portion in plan view as a pressure chamber 10 neighboring the pressure chamber 10 communicating with the aperture 12. As a result, because pressure chambers 10 can be arranged close to each other at a high density, high resolution image printing can be achieved with an ink-jet head 1 having a relatively small occupation area.

In the plane of FIGS. 5 and 6, pressure chambers 10 are arranged within an ink ejection region in two directions, that is, a direction along the longitudinal direction of the ink-jet head 1, called first arrangement direction, and a direction somewhat inclining from the lateral direction of the ink-jet head 1, called a second arrangement direction. The first and second arrangement directions form an angle theta, θ, somewhat smaller than the right angle. The ink ejection ports 8 are arranged at 50 dpi in the first arrangement direction. On the other hand, the pressure chambers 10 are arranged in the second arrangement direction such that the ink ejection region corresponding to one actuator unit 21 includes twelve pressure chambers 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the lateral direction of the ink-jet head 1. Therefore, in the ink-jet head 1 according to this embodiment, by ejecting ink droplets in order through a large number of ink ejection ports 8 arranged in the first and second directions with relative movement of a paper along the lateral direction of the ink-jet head 1, printing at 600 dpi in the main scanning direction can be performed.

Figure 8:
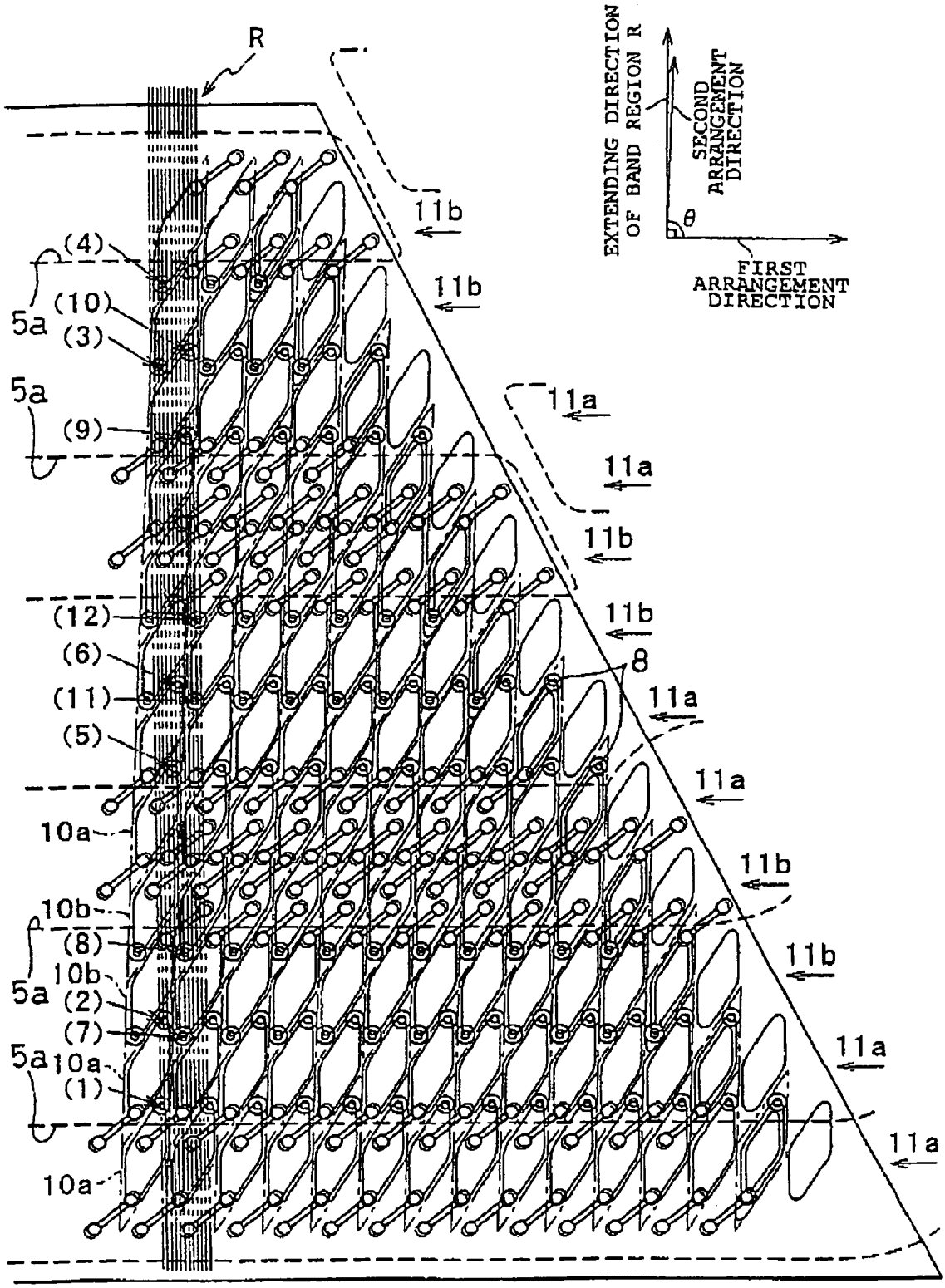
FIG. 8 is an enlarged view of the region enclosed by an alternate long and two short dashes line in FIG. 5.

Next, the structure of the passage unit 4 will be described in more detail with reference to FIG. 8. FIG. 8 is a schematic view showing the positional relation among each pressure chamber 10, each ink ejection port 8, and each aperture or restricted passage 12. Referring to FIG. 8, pressure chambers 10 are arranged in lines in the first arrangement direction at predetermined intervals at 50 dpi. Twelve lines of pressure chambers 10 are arranged in the second arrangement direction. As the whole, the pressure chambers 10 are two-dimensionally arranged in the ink ejection region corresponding to one actuator unit 21.

The pressure chambers 10 are classified into two types: pressure chambers 10*a*, in each of which a nozzle is connected with the upper acute portion in FIG. 8, and pressure chambers 10*b*, in each of which a nozzle is connected with the lower acute portion. Pressure chambers 10*a* and 10*b* are arranged in the first arrangement direction to form pressure chamber lines 11*a* and 11*b*, respectively. Referring to FIG. 8, in the ink ejection region corresponding to one actuator unit 21, from the lower side of FIG. 8, there are disposed two pressure chamber lines 11*a* and two pressure chamber lines 11*b* neighboring the upper side of the pressure chamber lines 11*a*. The four pressure chamber lines of the two pressure chamber lines 11*a* and the two pressure chamber lines 11*b* constitute a set of pressure chamber lines. Such a set of pressure chamber lines is repeatedly disposed three times from the lower side in the ink ejection region corresponding to one actuator unit 21. A straight line extending through the upper acute portion of each pressure chamber in each pressure chamber lines 11*a* and 11*b* crosses the lower oblique side of each pressure chamber in the pressure chamber line neighboring the upper side of that pressure chamber line.

As described above, when viewing perpendicularly to FIG. 8, two first pressure chamber lines 11*a* and two pressure chamber lines 11*b*, in which nozzles connected with pressure chambers 10 are disposed at different positions, are arranged alternately close to each other. Consequently, as an entire structure, the pressure chambers 10 are arranged in a uniform-like pattern. On the other hand, nozzles are arranged in a concentrated manner in a central region of each set of pressure chamber lines formed by the above four pressure chamber lines. Therefore, in case that each four pressure chamber lines form a set of pressure chamber lines and such a set of pressure chamber lines is repeatedly disposed three times from the lower side as described above, a region where no nozzle exists is formed near the boundary between each neighboring sets of pressure chamber lines, i.e., on both sides of each set of pressure chamber lines constituted by four pressure chamber lines. Wide sub-manifold channels 5*a* used for supplying ink to the corresponding pressure chambers 10 extend there. In this ink-jet head, in the ink ejection region corresponding to one actuator unit 21, four wide sub-manifold channels 5*a* are arranged in the first arrangement direction, i.e., one on the lower side of FIG. 8, one between the lowermost set of pressure chamber lines and the second lowermost set of pressure chamber lines, and two on both sides of the uppermost set of pressure chamber lines.

Referring to FIG. 8, nozzles communicating with ink ejection ports 8 for ejecting ink are arranged in the first arrangement direction at regular intervals at 50 dpi to correspond to the respective pressure chambers 10 uniformly arranged in the first arrangement direction. On the other hand, while twelve pressure chambers 10 are uniformly arranged also in the second arrangement direction forming an angle theta, θ, with the first arrangement direction, twelve nozzles corresponding to the twelve pressure chambers 10 include ones each communicating with the upper acute portion of the corresponding pressure chamber 10 and ones each communicating with the lower acute portion of the corresponding pressure chamber 10, and as a result, they are not uniformly arranged in the second arrangement direction at regular intervals.

If all nozzles communicate with the same-side acute portions of the respective pressure chambers 10, the nozzles are uniformly arranged also in the second arrangement direction at regular intervals. In this case, nozzles are arranged so as to shift in the first arrangement direction by a distance corresponding to 600 dpi printing resolution per pressure chamber line from the lower side to the upper side of FIG. 8. In contrast, in this ink-jet head, because four pressure chamber lines of two pressure chamber lines 11*a* and two pressure chamber lines 11*b* form a set of pressure chamber lines, and such a set of pressure chamber lines is repeatedly disposed three times from the lower side, the shift of nozzle position in the first arrangement direction per pressure chamber line from the lower side to the upper side of FIG. 8 is not always the same.

In the ink-jet head 1 of the embodiment, a band region R will be discussed that has a width (about 508.0 microns) corresponding to 50 dpi in the first arrangement direction and extends perpendicularly to the first arrangement direction. In this band region R, any of twelve pressure chamber lines includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to a 600 dpi printing resolution.

When the twelve nozzles included in one band region R are denoted by (1) to (12) starting from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the ink-jet head 1 having this structure, by properly driving active layers in the actuator unit 21, a character, an figure, or the like, having a resolution of 600 dpi can be formed. That is, by selectively driving active layers corresponding to the twelve pressure chamber lines in order in accordance with the transfer of a print medium, a specific character or figure can be printed on the print medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with transfer of a print medium, ink ejection starts from a nozzle in the lowermost pressure chamber line in FIG. 8. Ink ejection is then shifted upward with selecting a nozzle belonging to the upper neighboring pressure chamber line in order. Ink dots are thereby formed in order in the first arrangement direction adjacent to each other at 600 dpi.

Finally, all the ink dots form a straight line extending in the first arrangement direction at a resolution of 600 dpi.

On the other hand, in this ink-jet head, ink ejection starts from a nozzle in the lowermost pressure chamber line 11*a* in FIG. 8, and ink ejection is then shifted upward with selecting a nozzle communicating with the upper neighboring pressure chamber line in order in accordance with transfer of a print medium. In this embodiment, however, because the positional shift of nozzles in the first arrangement direction per pressure chamber line from the lower side to the upper side is not always the same, ink dots formed in order in the first arrangement direction in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber line 11*a* in FIG. 8 to form a dot row on the print medium at intervals corresponding to 50 dpi (about 508.0 microns). Next, as the print medium is transferred and the straight line formation position has reached the position of a nozzle (7) communicating with the second lowermost pressure chamber line 11*a*, ink is ejected through the nozzle (7). The second ink dot 16 is thereby formed at a position shifted from the first formed dot position in the first arrangement direction by a distance of six times the interval corresponding to 600 dpi (about 42.3 microns) (about 42.3 microns*6=about 254.0 microns).

Next, as the print medium is further transferred and the straight line formation position has reached the position of a nozzle (2) communicating with the third lowermost pressure chamber line 11*b*, ink is ejected through the nozzle (2). The third ink dot is thereby formed at a position shifted from the first formed dot position in the first arrangement direction by a distance of the interval corresponding to 600 dpi (about 42.3 microns). As the print medium is further transferred and the straight line formation position has reached the position of a nozzle (8) communicating with the fourth lowermost pressure chamber line 11*b*, ink is ejected through the nozzle (8). The fourth ink dot is thereby formed at a position shifted from the first formed dot position in the first arrangement direction by a distance of seven times the interval corresponding to 600 dpi (about 42.3 microns) (about 42.3 microns*7=about 296.3 microns. As the print medium is further transferred and the straight line formation position has reached the position of a nozzle (5) communicating with the fifth lowermost pressure chamber line 11*a*, ink is ejected through the nozzle (5). The fifth ink dot is thereby formed at a position shifted from the first formed dot position in the first arrangement direction by a distance of four times the interval corresponding to 600 dpi (about 42.3 microns) (about 42.3 microns*4=about 169.3 microns).

After this, in the same manner, ink dots are formed with selecting nozzles communicating with pressure chambers 10 in order from the lower side to the upper side in FIG. 8. In this case, when the number of a nozzle in FIG. 8 is N, an ink dot is formed at a position shifted from the first formed dot position in the first arrangement direction by a distance corresponding to (magnification n=N−1)*(interval corresponding to 600 dpi). When the twelve nozzles have been finally selected, the gap between the ink dots to be formed by the nozzles (1) in the lowermost pressure chamber lines 11 a in FIG. 8 at an interval corresponding to 50 dpi (about 508.0 microns) is filled up with eleven dots formed at intervals corresponding to 600 dpi (about 42.3 microns). Therefore, as the whole, a straight line extending in the first arrangement direction can be drawn at a resolution of 600 dpi.

Figure 9:
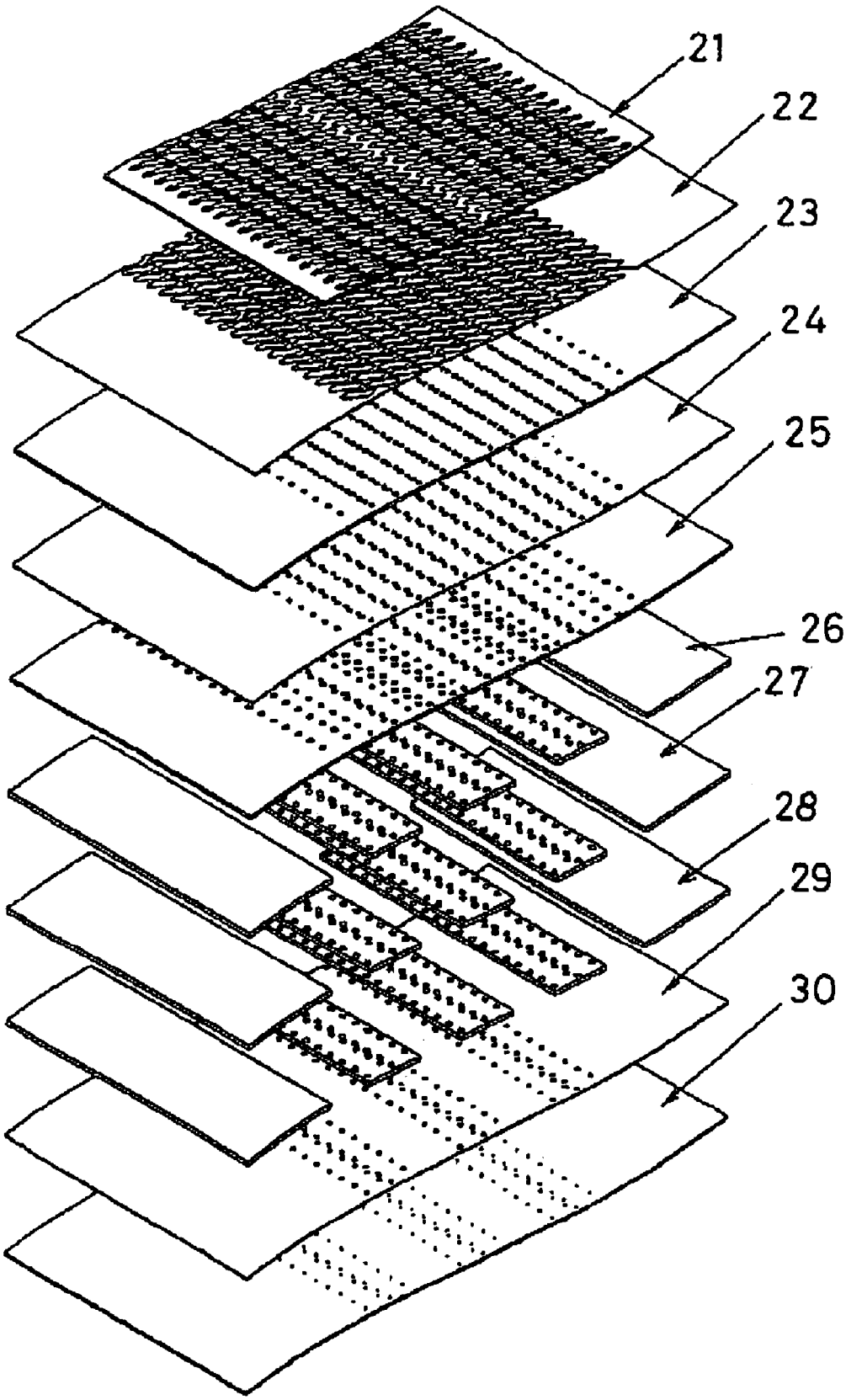
FIG. 9 is a partial exploded perspective view of the ink-jet head main body illustrated in FIG. 4.

Next, the sectional construction of the ink-jet head 1 according to this embodiment will be described. FIG. 9 is a partial exploded view of the head main body 1*a* of FIG. 4. Referring to FIGS. 7 and 9, a principal portion on the bottom side of the ink-jet head 1 has a layered structure laminated with ten sheet materials in total, i.e., from the top, an actuator unit 21, a cavity plate 22, abase plate 23, an aperture plate 24, a supply plate 25, manifold plates 26, 27, and 28, a cover plate 29, and a nozzle plate 30. Of them, nine plates other than the actuator unit 21 constitute a passage unit 4.

As described later in detail, the actuator unit 21 is laminated with four piezoelectric sheets 41 to 44 (see FIG. 11) and is provided with electrodes so that only the uppermost layer includes portions to be active only when an electric field is applied (hereinafter, simply referred to as "layer including active layers"), and the remaining three layers are inactive. The cavity plate 22, which is made of metal, has a large number of substantially rhombic openings that are formed corresponding to the respective pressure chambers 10. The base plate 23, which is also made of metal, includes a communication hole formed between each pressure chamber 10 of the cavity plate 22 and the corresponding aperture 12, and a communication hole formed between the pressure chamber 10 and the corresponding ink ejection port 8. The aperture plate 24, which is made of metal, includes, in addition to apertures 12, communication holes that are formed for connecting each pressure chamber 10 of the cavity plate 22 with the corresponding ink ejection port 8. The supply plate 25, which is made of metal, includes communication holes formed between each aperture 12 and the corresponding sub-manifold channel 5*a*, and communication holes formed for connecting each pressure chamber 10 of the cavity plate 22 with the corresponding ink ejection port 8. Each of the manifold plates 26, 27, and 2B, which is made of metal, includes, in addition to each sub-manifold channel 5*a*, communication holes that is formed for connecting each pressure chamber 10 of the cavity plate 22 with the corresponding ink ejection port 8. The cover plate 29, made of metal, includes communication holes formed for connecting each pressure chamber 10 of the cavity plate 22 with the corresponding ink ejection port 8. The nozzle plate 30, also made of metal, includes tapered ink ejection ports 8 functioning as a nozzles for the respective pressure chambers 10 of the cavity plate 22.

These ten sheets 21 to 30 are positioned in layers with each other to form such an ink passage 32 as illustrated in FIG. 7. The ink passage 32 first extends upward from the sub-manifold channel 5*a*, then extends horizontally in the aperture 12, then further extends upward, then again extends horizontally in the pressure chamber 10, then extends obliquely downward in a certain length away from the aperture 12, and then extends vertically downward toward the ink ejection port 8.

Figure 10:
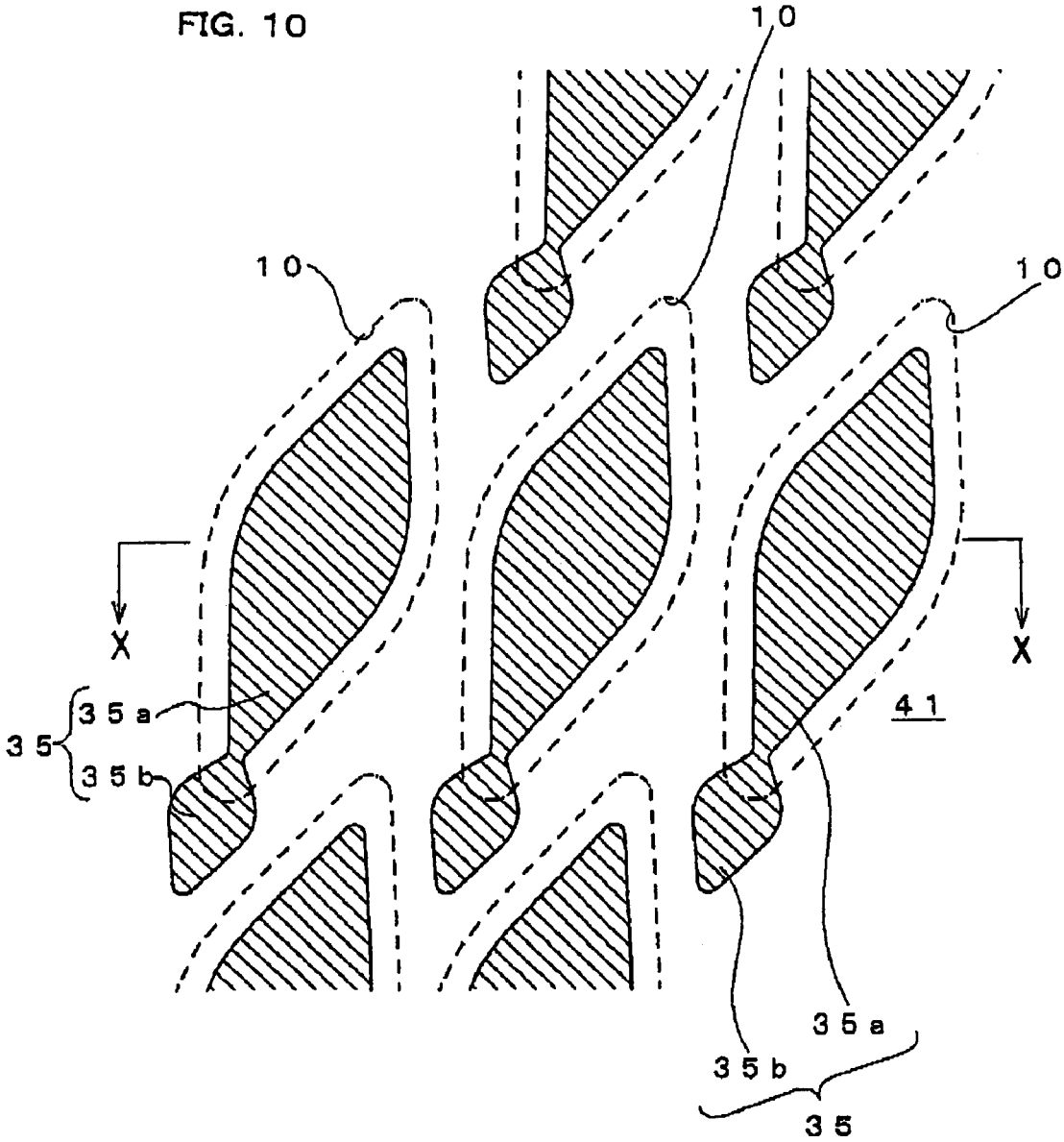
FIG. 10 is an enlarged plan view of an actuator unit in the region shown in FIG. 6.
Figure 11:
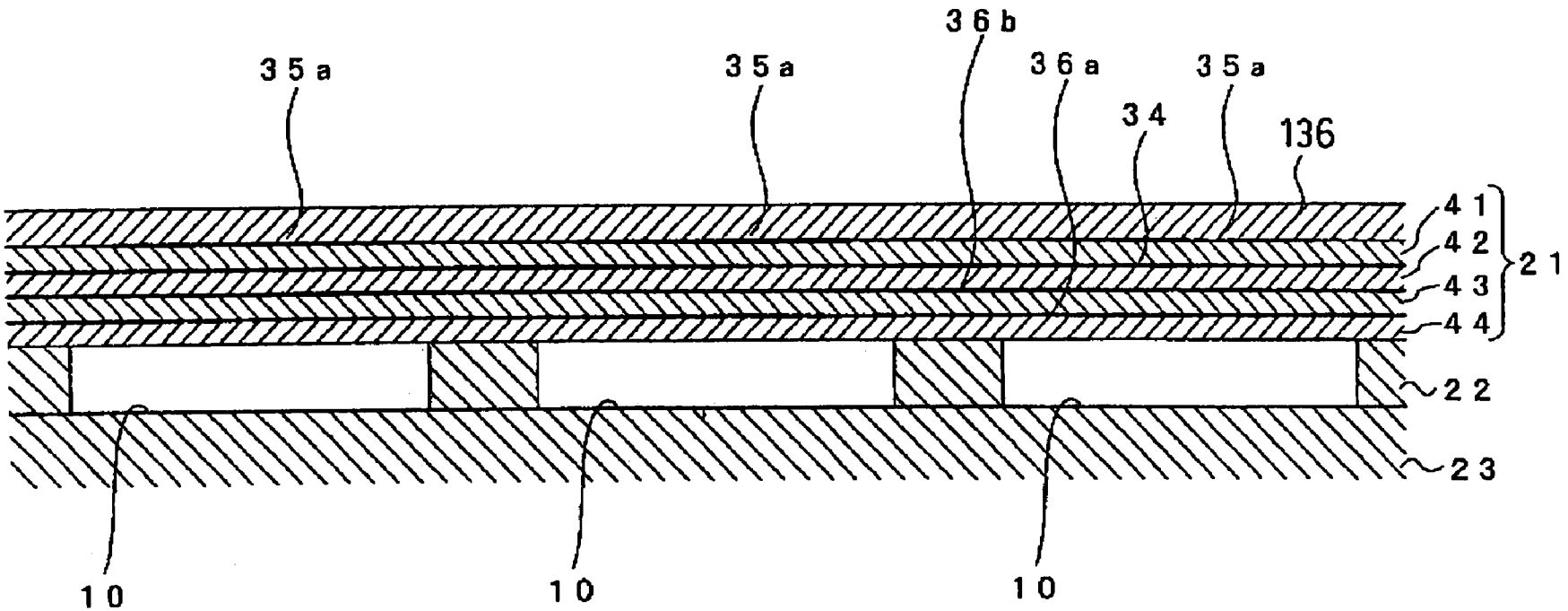
FIG. 11 is a partial sectional view of the ink-jet head main body shown in FIG. 4 and taken along line XI-XI of FIG. 10.

Next, the detailed structure of the actuator unit 21 will be described. FIG. 10 is an enlarged plan view of the actuator unit 21. FIG. 11 is a partial sectional view of the ink-jet head 1 and taken along line XI-XI of FIG. 10.

Referring to FIG. 10, an about 1.1 microns—thick individual electrode 35 is formed on the upper surface of the actuator unit 21 at a position substantially overlapping each pressure chamber 10 in a plan view. The individual electrode 35 is composed of a generally rhombic main electrode portion 35*a*, and a generally rhombic auxiliary electrode portion 35*b* formed continuously from one acute portion of the main electrode portion 35*a* and made smaller than the main electrode portion 35*a*. The main electrode portion 35*a* has a shape similar to that of the pressure chamber 10 and is smaller than the pressure chamber. The main electrode portion 35*a* is arranged so as to be contained in the pressure chamber 10 in a plan view. On the other hand, most part of the auxiliary electrode portion 35*b* extends out of the pressure chamber 10 in the plan view. A later-described piezoelectric sheet 41 is exposed from the region of the upper face of the actuator unit 21 other than the individual electrodes 35.

As shown in FIG. 11, the actuator unit 21 includes four piezoelectric sheets 41, 42, 43 and 44 formed to have the same thickness of about 15 microns. An FPC 136 used for supplying signals to control the potentials of the individual electrodes 35 and the common electrode 34 is adhered or bonded to the actuator unit 21. The piezoelectric sheets 41 to 44 are formed into a continuous laminar flat sheet (a continuous flat sheet layer), and are arranged across the numerous pressure chambers 10 formed in one ink discharge region in the ink-jet head 1. The piezoelectric sheets 41 to 44 are arranged as the continuous flat sheet layers across the numerous pressure chambers 10 so that the individual electrodes 35 can be arranged in a high density by using a screen printing technique, for example. Therefore, the pressure chambers 10, formed at positions corresponding to the individual electrodes 35, can also be arranged in a high density so that a high-resolution image can be printed. In this embodiment, the piezoelectric sheets 41 to 44 are made of a ceramic material of lead zirconate titanate-base (PZT) having ferroelectricity. In FIG. 11, the FPC 136 and the piezoelectric sheet 41 are shown to be bonded at all over their faces. However, as a practical matter, the two components may be bonded only at the auxiliary electrode portion 35*b* of each individual electrode 35. This bonding relation is also applied to FIG. 22 and FIG. 23.

Between the uppermost piezoelectric sheet 41 and the piezoelectric sheet 42 downward adjacent to the piezoelectric sheet 41, an about 2 micron-thick common electrode 34 is interposed formed on the entire face of the piezoelectric sheets With this configuration, a strength of the piezoelectric sheets can be increased, thus to prevent damages caused in handling them, and then to improve handling ability of the actuator unit 21. On the upper face of the actuator unit 21, i.e., on the upper face of the piezoelectric sheet 41, as described above, the individual electrodes 35 are formed for each of the pressure chambers 10. Each individual electrode 35 is composed of the main electrode portion 35*a* and the generally rhombic auxiliary electrode portion 35*b*. The main electrode portion 35*a* has a shape, for example, a length of 850 microns and a width of 250 microns, similar to the shape of the pressure chamber 10 in a plan view, so that a projection image of the main electrode portion 35*a* projected along the thickness direction of the individual electrode 35 is included in the corresponding pressure chamber. The auxiliary electrode portion 35*b* is made smaller than the main electrode portion 35*a*. Moreover, reinforcement metallic films 36*a* and 36*b* for reinforcing the actuator unit 21 are interposed between the piezoelectric sheets 43 and 44 and between the piezoelectric sheets 42 and 43, respectively. The reinforcement metallic films 36*a* and 36*b* are, similarly with the common electrode 34, formed on the entire face of the sheets, and have substantially the same thickness as that of the common electrode 34. In this embodiment, each individual electrode 35 is made of a laminated metallic material, in which nickel Ni, having a thickness of about 1 micron, and gold Au, having a thickness of about 0.1 microns, are formed as the lower and upper layers, respectively. Each of the common electrode 34 and the reinforcement metallic films 36*a* and 36*b* is made of a silver-palladium (Ag—Pd) base metallic material. The reinforcement metallic films 36*a* and 36*b* do not act as electrodes, so that they are not always required. However, by providing these reinforcement metallic films 36*a* and 36*b*, the brittleness of the piezoelectric sheets 41 to 44 after sintering can be compensated. This enables the piezoelectric sheets 41 to 44 to be easily handled.

The common electrode 34 is grounded in the region (not shown) through the FPC 136. Thus, the common electrode 34 is kept at the ground potential equally at a region corresponding to any pressure chamber 10. On the other hand, the individual electrodes 35 can be selectively controlled in their potentials independently of one another for the respective pressure chambers 10. For this purpose, the generally rhombic auxiliary electrode portion 35*b* of each individual electrode 35 is, in independence, electrically bonded with a driver IC 132 through a lead wire (not shown) provided at the FPC 136. Thus, in this embodiment, the individual electrodes 35 are connected with the FPC 136 at the auxiliary electrode portions 35*b* outside the pressure chambers 10 in a plan view, so that the deformation of the actuator unit 21 in the thickness direction is blocked less. Therefore, the change in the volume of each pressure chamber 10 can be increased. In a modification, many pairs of common electrodes 34, each having shape larger than that of a pressure chamber 10 so that the projection image of each common electrode projected along the thickness direction of the common electrode may include the pressure chamber, may be provided for each pressure chamber 10. In another modification, many pairs of common electrodes 34, each having a shape slightly smaller than that of a pressure chamber 10 so that the projection image of each common electrode projected along the thickness direction of the common electrode may be included in the pressure chamber, may be provided for each pressure chamber 10. Thus, the common electrode 34 may not always be a single conductive layer formed on the entire face of a piezoelectric sheet. In the above modifications, however, all the common electrodes must be electrically connected with one another so that the portion corresponding to any pressure chamber 10 may be at the same potential.

In the ink-jet head 1 according to this embodiment, the piezoelectric sheets 41 to 44 are to be polarized in their thickness direction. That is, the actuator unit 21 has the so-called "unimorph structure," in which the uppermost (as located at the most distant from the pressure chamber 10) piezoelectric sheet 41 is the layer wherein active layers are located, and the lower (i.e., near the pressure chamber 10) three piezoelectric sheets 42 to 44 are made into inactive layers. When the individual electrode 35 is set at a positive or negative predetermined potential, therefore, the portions of the piezoelectric sheet 41 to 43, as sandwiched between the electrodes, act as the active layers to contract perpendicularly of the polarization by the transversal piezoelectric effect, if the electric field and the polarization are in the same direction, for example. On the other hand, because the piezoelectric sheets 42 to 44 are not affected by the electric field, they do not contract by themselves. Thus, a difference in strain perpendicular to the polarization is produced between the uppermost piezoelectric sheet 41 and the lower piezoelectric sheets 42 to 44. As a result, the piezoelectric sheets 41 to 44 are ready to deform (i.e., the unimorph deformation) into a convex shape toward the inactive side. At this time, as shown in FIG. 11, the lower face of the piezoelectric sheets 41 to 44 is fixed on the upper face of the partition (or the cavity plate) 22 defining the pressure chamber, so that the piezoelectric sheets 41 to 44 deform into the convex shape toward the pressure chamber side. Therefore, the volume of the pressure chamber 10 is decreased to raise the pressure of ink so that the ink is ejected from the ink ejection port 8. After this, when the individual electrode 35 is returned to the same potential as that of the common electrode 34, the piezoelectric sheets 41 to 44 restore the original shape, and the pressure chamber 10 also restores its original volume so that the pressure chamber 10 draws the ink from the manifold channel 5.

In another driving method, all the individual electrodes 35 are set in advance at a potential different from that of the common electrode 34. When an ejection request is issued, the corresponding individual electrode 35 is set at the same potential as that of the common electrode 34. After this, at a predetermined timing, the individual electrodes 35 can also be set again at the potential different from that of the common electrode 34. In this case, at the timing when the individual electrode 35 is set at the same potential as that of the common electrode 34, the piezoelectric sheets 41 to 44 return to their original shapes. The corresponding pressure chamber 10 is thereby increased in volume from its initial state (in which potentials of both electrodes are different from each other), such that the ink is drawn from the manifold channel 5 into the pressure chamber 10. After this, at the timing when the individual electrode is set again at the potential different from that of the common electrode 34, the piezoelectric sheets 41 to 44 deform into a convex shape toward the pressure chamber 10. The volume of the pressure chamber 10 is thereby decreased, and the pressure of ink in the pressure chamber 10 is raised to eject the ink.

On the other hand, in the case when the polarization occurs in the reverse direction to the electric field applied to the piezoelectric sheets 41 to 44, the active layers in the piezoelectric sheet 41 sandwiched by the individual electrodes 35 and the common electrode 34 are ready to elongate perpendicularly to the polarization by the transversal piezoelectric effect. As a result, the piezoelectric sheets 41 to 44 deform into a concave shape toward the pressure chamber 10. Therefore, the volume of the pressure chamber 10 is increased to draw ink from the manifold channel 5. After this, when the individual electrodes 35 return to their original potential, the piezoelectric sheets 41 to 44 also return to their original flat shape. The pressure chamber 10 thereby returns to its original volume to eject ink through the ink ejection port 8.

Thus, in the ink-jet head 1 according to this embodiment, the active layers are contained only in the piezoelectric sheet 41, which is one of the outermost layers of the actuator unit 21 and the most distant from the pressure chamber, and the individual electrodes 35 are formed only on the outermost face (or the upper face). Therefore, the actuator unit 21 can be easily manufactured because a through hole need not be formed for connecting the individual electrodes overlapping in a plan view.

In the ink-jet head 1 according to this embodiment, moreover, the piezoelectric sheets 42, 43 and 44 as the three inactive layers are arranged between the piezoelectric sheet 41 containing the active layers at the most distant from the pressure chamber 10 and the passage unit 4. Thus, by forming the three inactive layers for one piezoelectric sheet including active layers, the change in the volume of the pressure chamber 10 can be made to be relatively large. Lowering the voltage to be applied to each individual electrode 35, a decrease in size of each pressure chamber 10, and high-density arrangement of the pressure chambers 10 can be intended thereby. This has been confirmed by the present inventors. Moreover, the actuator unit 21 is constituted by laminating the inactive layers having a thickness larger than that of the piezoelectric sheet 41 including the active layers, so as to compensate brittleness of the piezoelectric sheet 41, thereby improving handling ability of the actuator unit 21. This enables the ink-jet head to be easily manufactured without handling with any high accuracy.

In the ink-jet head 1, because the piezoelectric sheet 41 including the active layers and the piezoelectric sheets 42 to 44 as the inactive layers are made of the same material, the material need not be changed in the manufacturing process. Thus, they can be manufactured through a relatively simple process, and a reduction of manufacturing cost is expected. Further, for the reason that each of the piezoelectric sheet 41 including active layers and the piezoelectric sheets 42 to 44 as the inactive layers has substantially the same thickness, a further reduction of cost can be intended by simplifying the manufacturing process. This is because control of the thickness can easily be performed when the ceramic materials to be the piezoelectric sheets are put in layers. Further, since the inactive layers are made of a lamination of the three piezoelectric sheets 42 to 44, decrease in voltage endurance of the active layers sandwiched between the individual electrodes 35 and the common electrode 34 and occurrence of short-circuit caused by the ink penetrating into the piezoelectric sheet 41 can be prevented, and therefore, occurrence of distribution of piezoelectric property depending on positions in the actuator unit 21 is restrained. As a result, an ink-jet head 1 having a uniform ink-ejecting property regardless of positions therein can be obtained.

In addition, in the ink-jet head 1, by sandwiching the piezoelectric sheet 41 by the common electrode 34 and the individual electrodes 35, the volume of each pressure chamber 10 can easily be changed by the piezoelectric effect. Further, because the piezoelectric sheet 41 including active layers is in a shape of a continuous flat layer, it can easily be manufactured.

The ink-jet head 1 according to this embodiment is provided with the actuator unit 21 having the unimorph structure, in which the piezoelectric sheets 42 to 44 near the pressure chamber 10 are made into the inactive layer whereas the piezoelectric sheet 41 distant from the pressure chamber 10 is made into a layer containing the active layers. Therefore, the change in the volume of the pressure chamber 10 can be increased by the transversal piezoelectric effect. As compared with the ink-jet head in which the active layers are formed on a piezoelectric sheet near the pressure chamber 10 whereas the inactive layer is formed on piezoelectric sheet(s) distant from the pressure chamber 10, it is possible to lower the voltage to be applied to the individual electrode 35 and/or to arrange the pressure chambers 10 highly densely. By lowering the applied voltage, the driver IC for driving the individual electrodes 35 can be made smaller, and the cost can be reduced. In addition, a size of the pressure chamber 10 can be reduced. Even in the case of a high-density arrangement of the pressure chambers 10, moreover, a sufficient amount of ink can be ejected. Thus, it is possible to decrease the size of the head 1 and to arrange the printing dots highly densely.

Next, a first manufacture method of the ink-jet head 1 shown in FIG. 4 will be further described with reference to FIG. 12 to FIG. 15.

Figure 12:
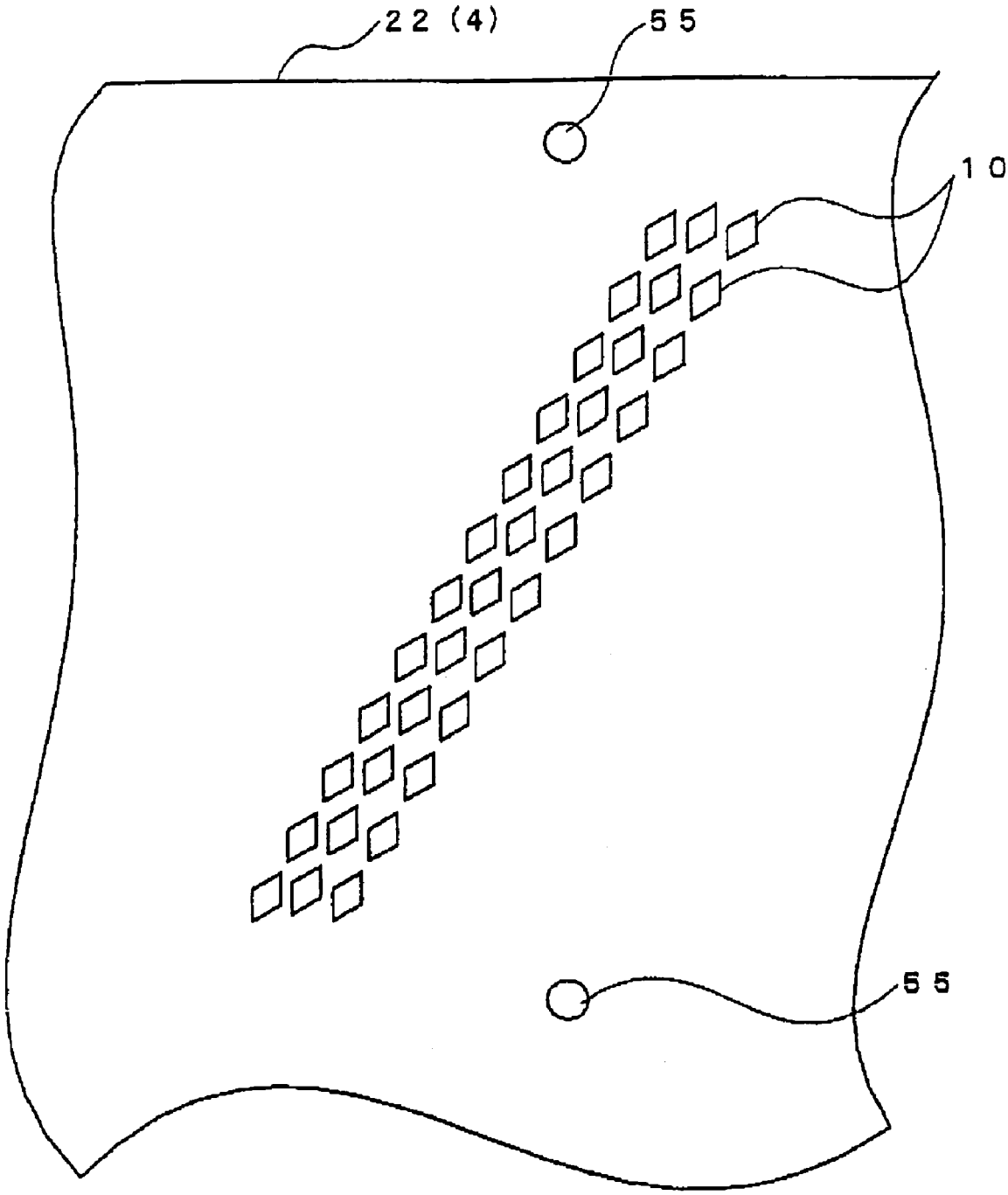
FIG. 12 is a plan view showing a cavity plate, in which marks are formed at a step in the course of the manufacture of the ink-jet head shown in FIG. 4 and based on a first manufacture method.

To manufacture the ink-jet head 1, a passage unit 4 and each actuator unit 21 are separately manufactured in parallel and then both are bonded to each other. To manufacture the passage unit 4, each plate 22 to 30 forming the passage unit 4 is subjected to etching using a patterned photoresist as a mask, thereby forming openings as illustrated in FIGS. 7 and 9 in the respective plates 22 to 30. As part of this manufacture method, as shown in FIG. 12, as the pressure chambers 10 are formed in the cavity plate 22, round marks (or cavity position recognition marks) 55 are simultaneously formed at an etching step. In other words, the cavity plate 22 is etched by using the photoresist having apertures at portions corresponding to the pressure chambers 10 and the marks 55, as the mask. The marks 55 are provided for positioning the printing positions of the later-described individual electrodes 35 and are formed outside of the ink ejecting region, for example, at a predetermined longitudinal interval of the cavity plate 22 and at two portions spaced in the widthwise direction of the cavity plate 22. The marks 55 may be exemplified by holes or recesses. FIG. 12 shows only some of the numerous pressure chambers 10.

In a modification, the marks 55 may be formed at a step different from the etching step of forming the pressure chambers 10, that is, by using another photoresist as the mask. By performing the etching step of forming the marks 55 simultaneously with the etching step of forming the pressure chambers 10, however, the precision of positioning the marks 55 with respect to the pressure chambers 10 can be enhanced, which improves the positioning precision of the individual electrodes 35 and the pressure chambers 10, as will be described later.

Moreover, the remaining eight plates 23 to 30 other than the cavity plate 22 are etched to form the apertures. After this, the passage unit 4 is prepared by overlaying and adhering the nine plates 22 to 33 through an adhesive to form an ink passage 32.

Figure 13A:
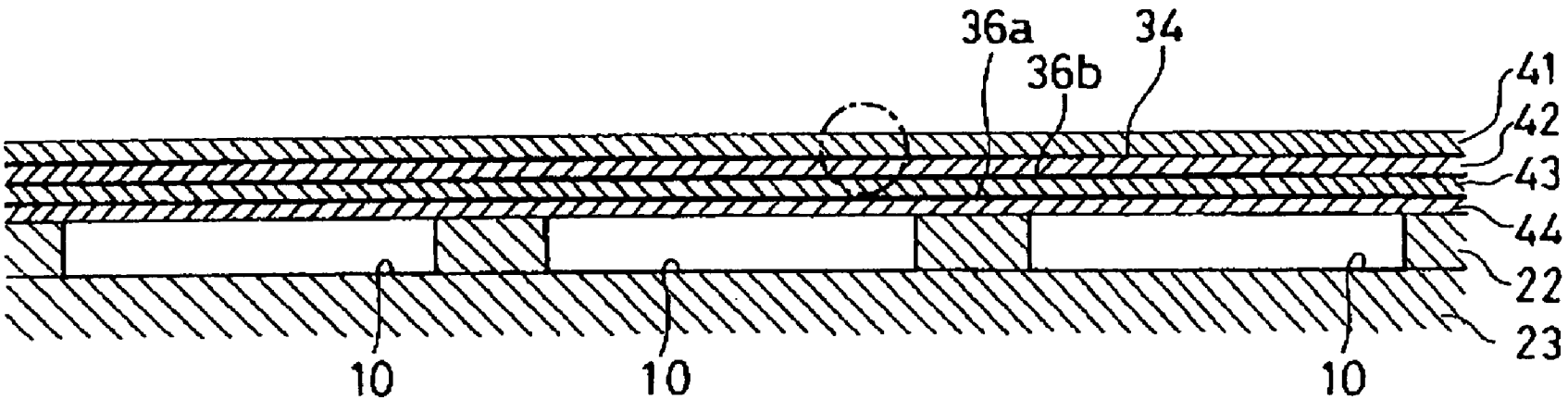
FIG. 13A and FIG. 13B are partial sectional views at individual steps in the course of the manufacture of the ink-jet head shown in FIG. 4 and based on the first manufacture method embodiment of the invention.
Figure 14A:
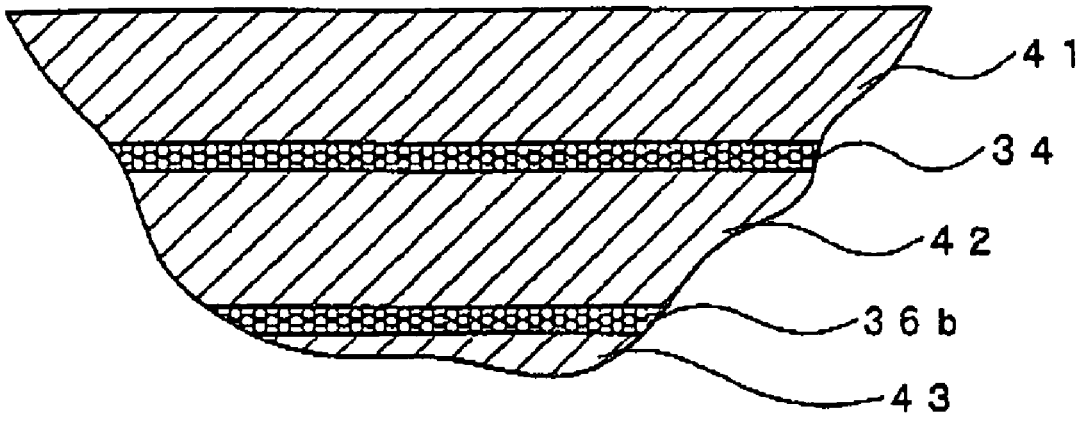
FIG. 14A and FIG. 14B are partial enlarged sectional views of the actuator unit at individual steps in the course of the manufacture of the ink-jet head shown in FIG. 4 and based on the first manufacture method embodiment of the invention.
Figure 14B:
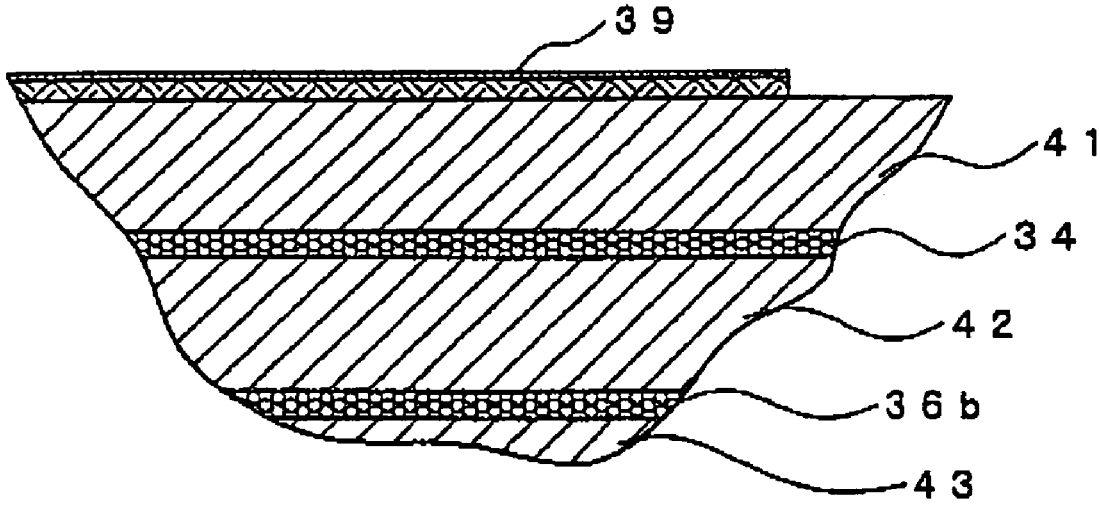

In order to prepare the actuator unit 21, on the other hand, a conductive paste to be a reinforcement metallic film 36*a* is printed in a pattern on a green sheet of a ceramics material to be a piezoelectric sheet 44. In parallel with this, an electrically conductive paste to be a reinforcement metallic film 36*b* is printed in a pattern on a green sheet of a ceramics material to be a piezoelectric sheet 43, and a conductive paste to be a common electrode 34 is printed in a pattern on a green sheet of a ceramics material to be a piezoelectric sheet 42. After this, a layered structure is prepared by overlaying the four piezoelectric sheets 41 to 44 while positioning them with a jig and is sintered at a predetermined temperature. As a result, a layered structure (or the piezoelectric sheet containing member) is formed which has the common electrode 34 formed on the lower face of the piezoelectric sheet 41 at the uppermost layer but does not have the individual electrodes. Next, the layered structure to be the actuator unit 21 manufactured as described above is bonded or fixed to the passage unit 4 with an adhesive so that the piezoelectric sheet 44 is to be in contact with the cavity plate 22. At this time, both are bonded to each other on the basis of marks 55 and 55*a* (as referred to FIG. 15) for positioning formed on the surface of the cavity plate 22 of the passage unit 4 and the surface of the piezoelectric sheet 41, respectively. Here, a high precision is generally not required for this positioning because the individual electrodes are not formed yet on the layered structure to be the actuator unit 21. The sectional view of the ink-jet head at this time, as corresponding to FIG. 11, is presented in FIG. 13A, and a partially enlarged view of the region, as enclosed by an alternate long and short dash line, is shown in FIG. 14A. The mark 55*a* on the piezoelectric sheet 41 may be formed either before or after the piezoelectric sheets 41 to 44 are baked.

Figure 13B:
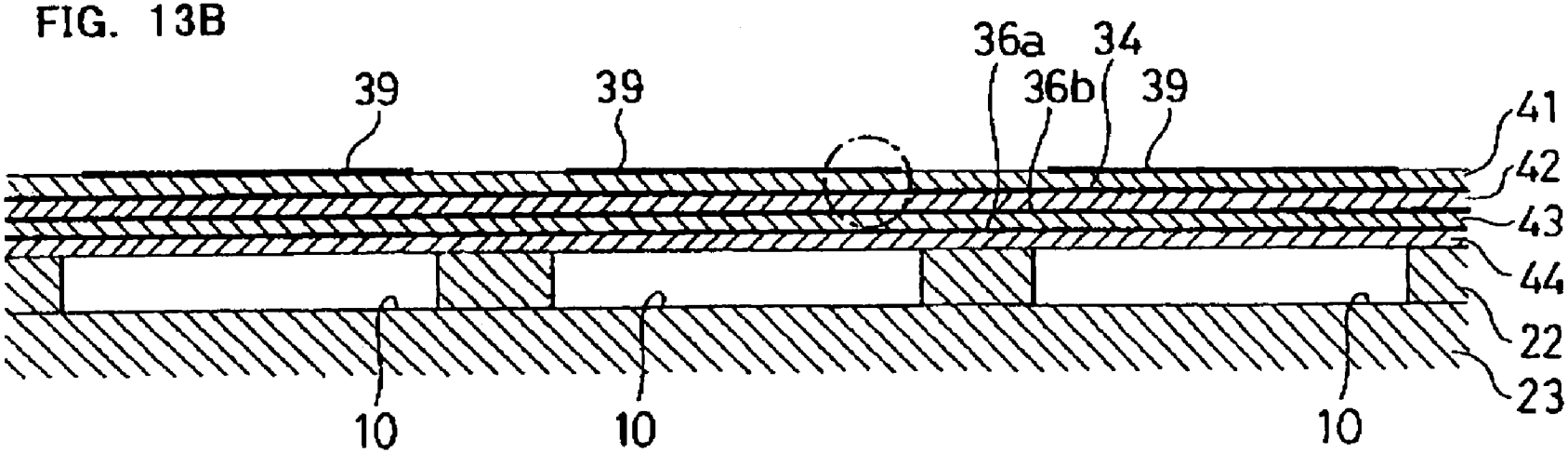
Figure 15:
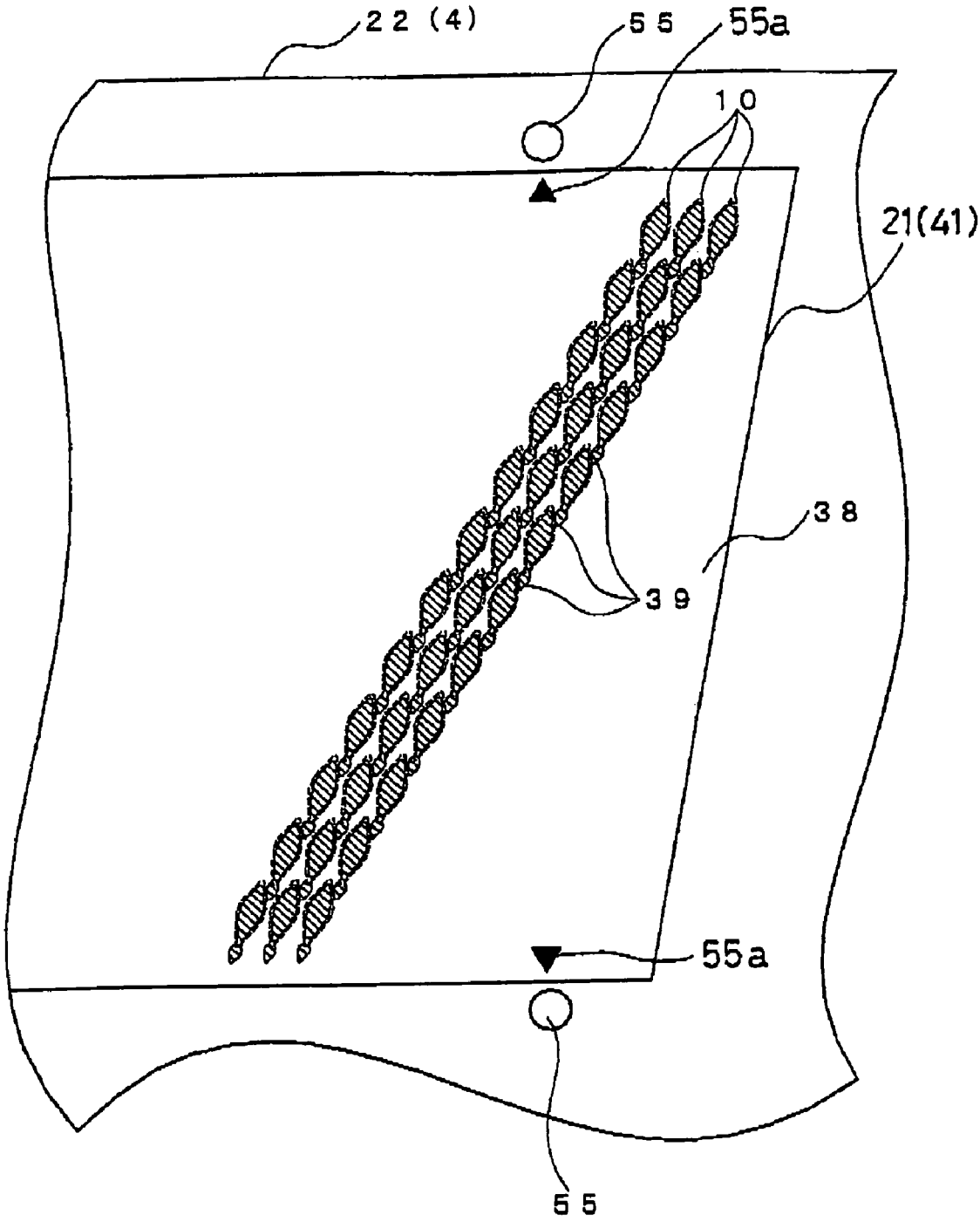
FIG. 15 is a plan view for explaining a region to be printed, at a step in the course of the manufacture of the ink-jet head shown in FIG. 4 and based on the first manufacture method embodiment of the invention.

After this, as shown in FIG. 13B and FIG. 15, the marks 55 formed on the cavity plate 22 are optically recognized, and conductive pastes 39 to be individual electrodes 35 are printed in a pattern at the aforementioned positions over the piezoelectric sheet 41 with reference to the positions of the marks 55 recognized. At this time, the region of FIG. 13B, as enclosed by an alternate long and short dash line, is presented in FIG. 14B.

Next, the pastes 39 are sintered at a sintering step. As a result, the individual electrodes 35 are formed on the piezoelectric sheet 41, and the actuator unit 21 is prepared. Here at this sintering step, the adhesive for bonding the passage unit 4 and the layered structure to be the actuator unit 21 has to be exemplified by one having a heat-resisting temperature higher than the sintering temperature for sintering the pastes 39 printed in a pattern of the individual electrodes 35, or the material for the pastes 39 has to be exemplified by one having a sintering temperature lower than the heat-resisting temperature of the adhesive for bonding the passage unit 4 and the actuator unit 21.

After this, the FPC 136 for feeding the electric signals to the individual electrodes 35 is electrically jointed by soldering to the actuator unit 21, and the manufacture of the ink-jet head 1 is completed through further predetermined steps. Moreover, the common electrode 34 is kept at the ground potential by connecting the wiring lines in the FPC 136 with the common electrode 34.

In the ink-jet head manufacturing method thus far described, the pattern of the individual electrodes 35 is formed by sintering the paste 39 which has been printed in a pattern on the basis of the marks 55 formed on the passage unit 4 hating the pressure chambers 10. As compared with the case in which the actuator unit having the individual electrodes formed in advance is bonded to the passage unit, therefore, the positioning precision of the individual electrodes 35 formed on the piezoelectric sheet 41 relative to the pressure chambers 10 is improved. As a result, the ink ejecting performance has an excellent homogeneity so that the ink-jet head 1 is easily elongated. In contrast to the ink-jet head 1 of this embodiment in which a plurality of actuator units 21 are provided and arrayed in the longitudinal direction of the passage unit 4, it is possible to use only one actuator unit 21 which is as long as the passage unit 4.

Further, in this manufacture method, the pastes 39 are printed and sintered after the piezoelectric sheets 41 to 44 and the passage unit 4 are bonded, as described above, so that the actuator units 21 can be easily handled. Moreover, the individual electrodes 35 can be printed by means of the printer which is used for forming the common electrode 34, so that the manufacture cost can be reduced.

Further, in this manufacture method, the individual electrodes are not formed between the adjoining piezoelectric sheets 41 to 44 when these piezoelectric sheets are laminated, that is, only the piezoelectric sheet 41 most distant from the pressure chambers 10 is a layer containing the active layers. Therefore, the through holes used for connecting the individual electrodes overlapping one another in a plan view need not be formed in the piezoelectric sheets 41 to 44. According to this manufacture method, the ink-jet head 1 can be manufactured at a low cost by the relatively simple steps, as described before.

In this manufacture method, moreover, the four piezoelectric sheets 41 to 44 are laminated such that only the uppermost piezoelectric sheet 41 is a layer containing the active layers, and the remaining three piezoelectric sheets 42 to 44 are inactive layers. According to the ink-jet head 1 thus manufactured, the volume change of the pressure chambers 10 can be made relatively large, as described above. Therefore, it is possible to lower the drive voltage of the individual electrodes 35 and to reduce the size and raise the density of the pressure chambers 10.

As a deformation example process, a lamination having the piezoelectric sheets 41 to 44 is first baked, the mark 55*a* and the individual electrodes 35 are next formed on the piezoelectric sheet 41, and thereafter the actuator unit 21 and the passage unit 4 are adhered to each other. The mark 55*a* and the individual electrodes 35 are formed by performing a baking process after a pattern of the conductive paste has been printed. If the mark 55*a* is formed in advance on the piezoelectric sheet 41, the individual electrodes 35 may be formed on the basis of the mark 55*a*. In any case, the dimension of the baked lamination (piezoelectric sheets 41 to 44) seldom varies in baking tie paste for forming the individual electrodes 35. Therefore, the individual electrodes 35 and the pressure chambers 10 formed in the passage unit 4 can be aligned with good accuracy over the whole actuator unit 21 by aligning the passage unit 4 and the piezoelectric sheet 41 in such a manner that the mark 55 on the passage unit 4 and the mark 55*a* on the piezoelectric sheet 41 have the prescribed positional relationship with each other. Further, according to this deformation example, there is no need to perform a heat treatment for baking the individual electrodes 35 after adhering the actuator unit 21 and the passage unit 4, thereby advantageously increasing the degree of freedom of the selection of adhesive used for adhering the actuator unit 21 and the passage unit 4.

As mentioned above, providing the reinforcement metallic films 36*a* and 36*b* reinforces the brittleness of the piezoelectric sheets 41 to 44, thereby improving the handling ability of the piezoelectric sheets 41 to 44. However, it is not always necessary to provide the reinforcement metallic films 36*a* and 36*b*. For example, when the size of the actuator unit 21 is approximately 1 inch, the handling ability of the piezoelectric sheets 41 to 44 is not damaged by brittleness even if the reinforcement metallic films 36*a* and 36*b* are not provided.

Further, according to this embodiment, the individual electrodes 35 are formed only on the piezoelectric sheet 41 as described above. On the other hand, when individual electrodes are also formed on the piezoelectric sheets 42 to 44, i.e., other than the piezoelectric sheet 41, the individual electrodes have to be printed on the desired piezoelectric sheets 41 to 44 before laminating and baking the piezoelectric sheets 41 to 44. Accordingly, the contraction of piezoelectric sheets 41 to 44 in baking causes a difference between the positional accuracy of the individual electrodes on the piezoelectric sheets 42 to 44 and the positional accuracy of the individual electrodes 35 on the piezoelectric sheet 41. According to this exemplary embodiment, however, because the individual electrodes 35 are formed only on the piezoelectric sheet 41, such difference in positional accuracy is not caused and the individual electrodes 35 and the corresponding pressure chambers 10 are aligned with good accuracy.

Figure 16A:
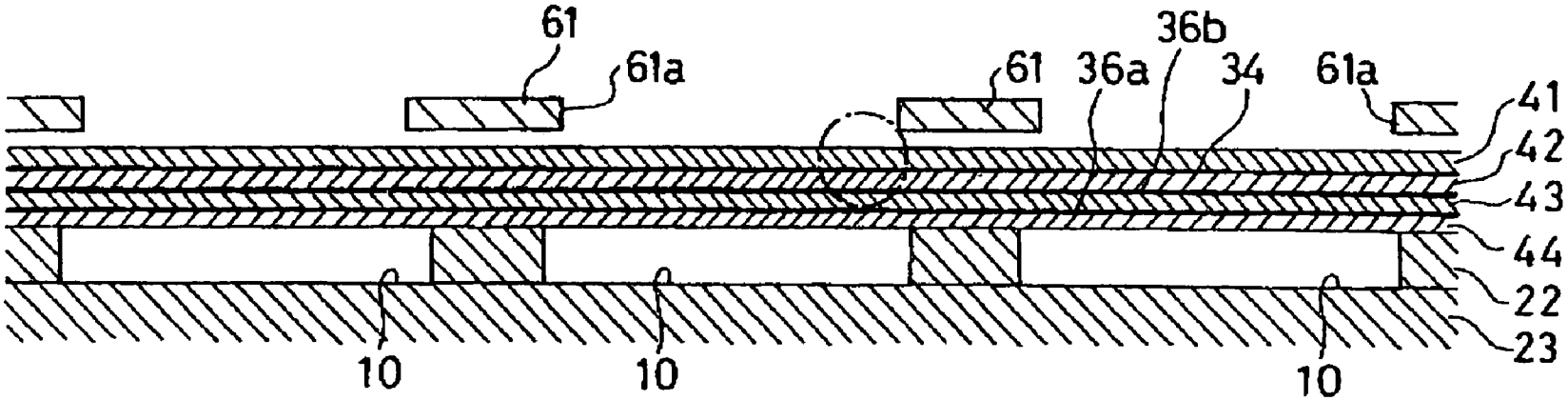
FIG. 16A and FIG. 16B are partial sectional views at individual steps in the course of the manufacture of the ink-jet head shown in FIG. 4 and based on a second manufacture method embodiment of the invention.

Next, a second manufacture method of the ink-jet head 1 will be further described with reference to FIG. 16 to FIG. 18. Here, the steps up to the bonding step shown in FIG. 13A are identical, and thus their description has been omitted.

First, from the bonded state shown in FIG. 13A, the marks 55 formed on the cavity plate 22 are optically recognized, and a metal mask 61 is arranged over the piezoelectric sheet 41 with respect to the positions of the recognized marks 55. As shown in FIG. 18, in this metal mask 61, a number of apertures 61*a* of the same shape as that of the individual electrodes 35 are formed in the same matrix array as that of the individual electrodes 35. The metal mask 61 is positioned by means of a jig on the basis of the marks 55 so that the positions of the apertures 61*a* may be aligned with the positions at which the individual electrodes 35 are to be formed. The apertures 61*a* of the metal mask 61 may be etched in advance by using a photoresist as the mask. A sectional view of the ink-jet head at this time corresponding to FIG. 11 is presented in FIG. 16A, and the partial enlarged view of a region enclosed by an alternate long and short dash line is presented in FIG. 17A.

Figure 16B:
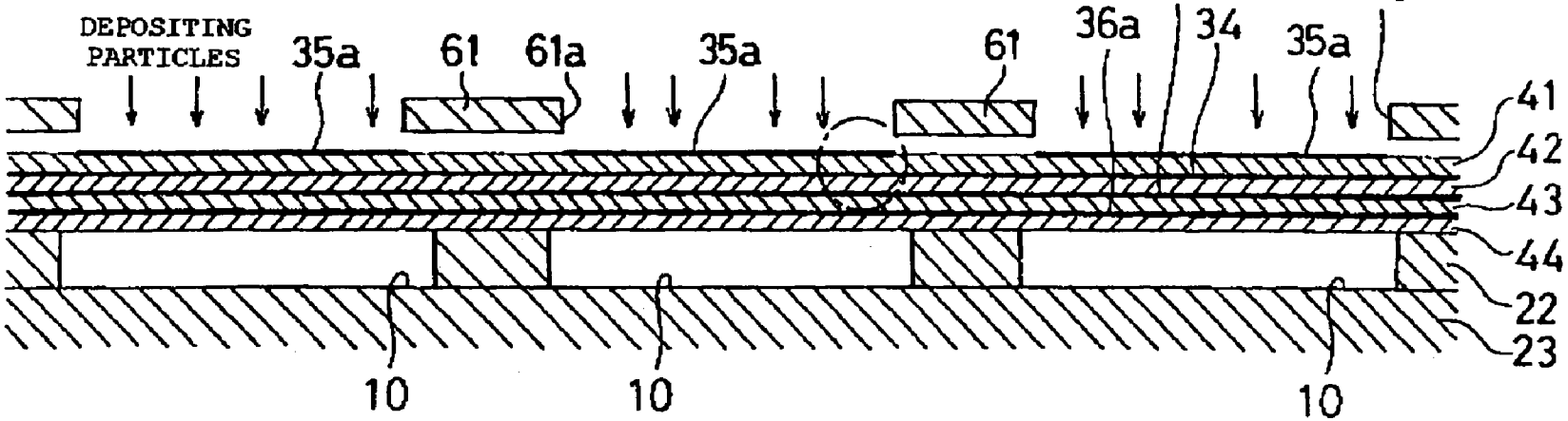
Figure 17A:
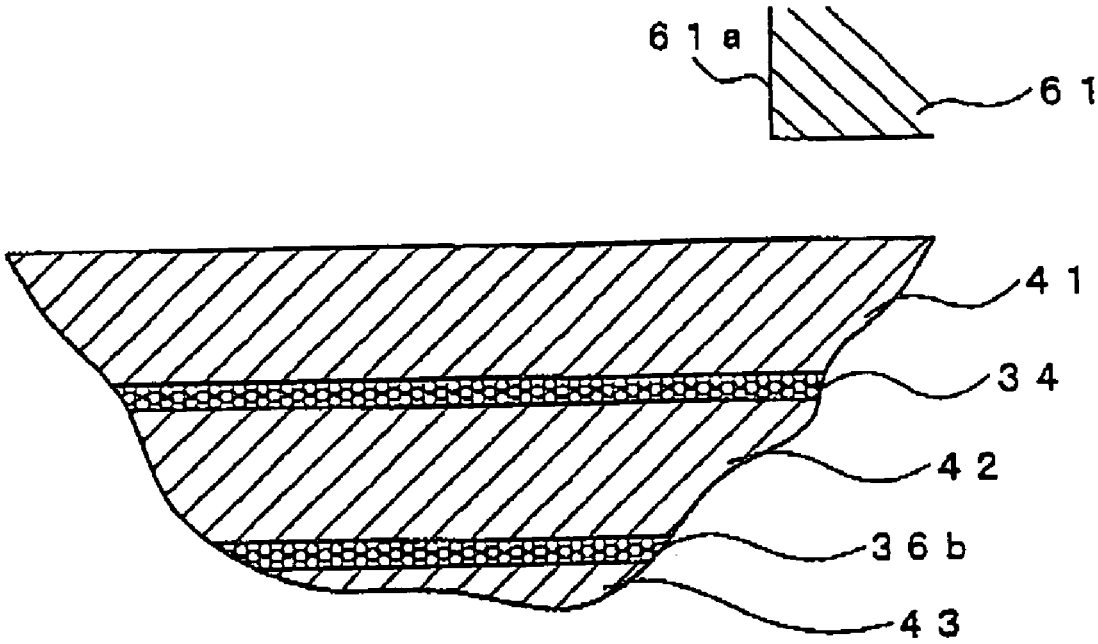
FIG. 17A and FIG. 17B are partial enlarged sectional views of the actuator unit at individual steps in the course of the manufacture of the ink-jet head shown in FIG. 4 and based on the second manufacture method embodiment of the invention.
Figure 17B:
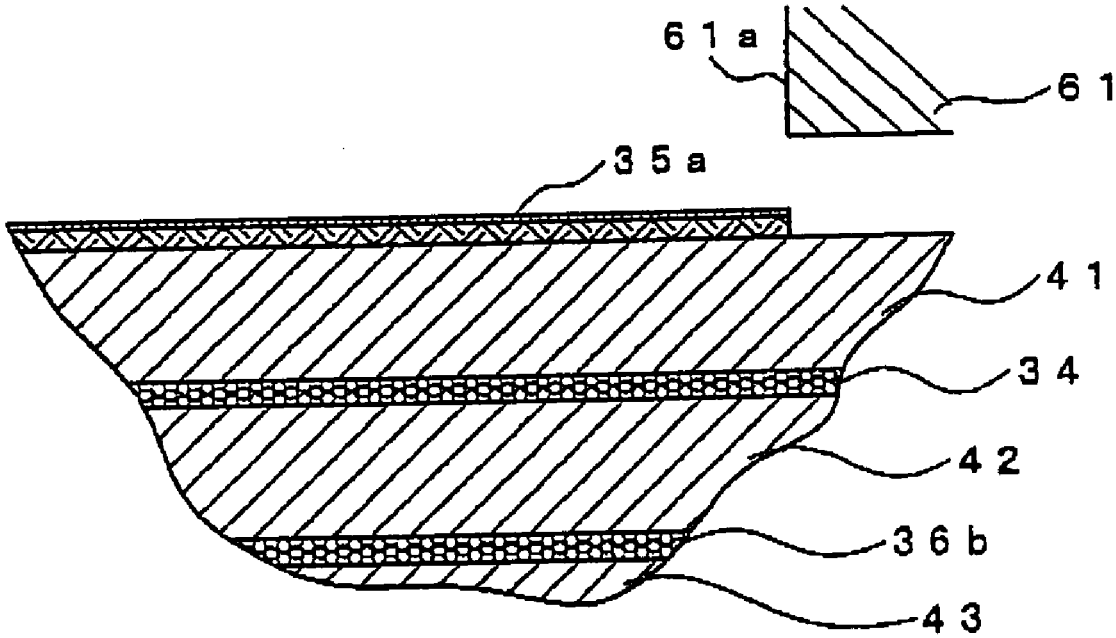
Figure 18:
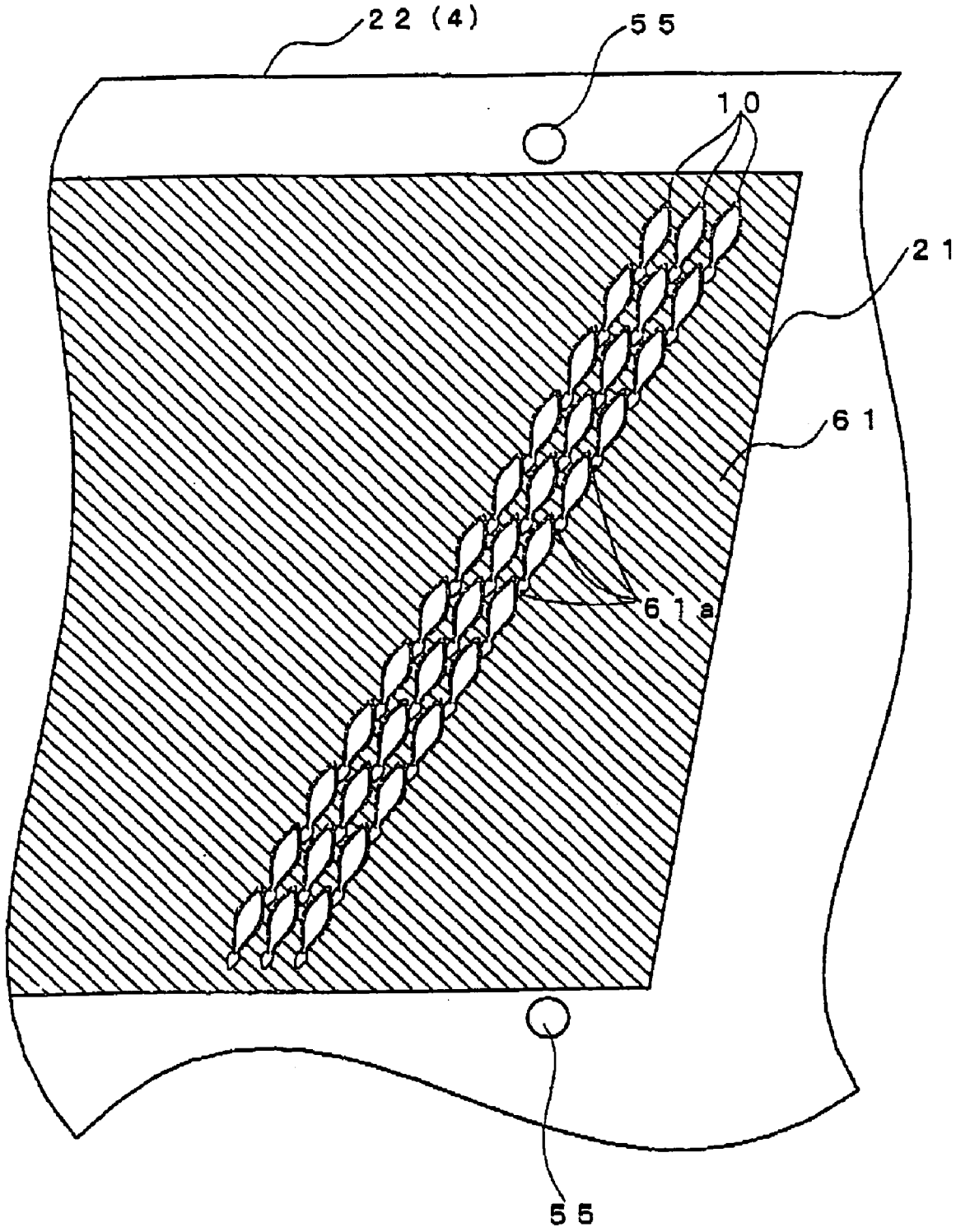
FIG. 18 is a plan view for explaining a region, in which a metal mask is arranged, at a step in the course of the manufacture of the ink-jet head shown in FIG. 4 and based on the second manufacture method embodiment of the invention.

As shown in FIG. 16B and FIG. 17B or a partial enlarged view of the region enclosed by an alternate long and short dash line of FIG. 16B, conductive films as the individual electrodes 35 are formed in a pattern by the PVD (Physical Vapor Deposition) process on the piezoelectric sheet 41 exposed from the apertures 61*a* of the metal mask 61. Here, the individual electrodes 35 maybe formed in a pattern by the CVD (Chemical Vapor Deposition) in place of the PVD. Moreover, it is arbitrary to form the Ni of the lower layer and the Au of the surface layer of the conductive film to be the individual electrodes 35 by the PVD or to form the lower layer Ni by the PVD and the surface layer Au by plating it.

After this, the manufacture of the ink-jet head 1 is completed by moving the metal mask 61 from over the passage unit 4, applying the FPC 136 for feeding the electric signals to the individual electrodes 35, to the actuator unit 21, and by predetermined steps.

Thus, according to this exemplary manufacture method embodiment, the pattern of the individual electrodes 35 is formed by the PVD process using the metal mask 61 which is arranged based on the marks 55 formed on the passage unit 4 of the pressure chambers 10. As compared with the case in which the actuator unit having the individual electrodes formed in advance is bonded to the passage unit, the positioning precision of the individual electrodes 35 formed on the piezoelectric sheet 41 relative to the pressure chambers 10 is improved. As a result, the homogeneity of the ink ejecting performance is improved to make it easy to elongate the ink-jet head 1.

With the individual electrodes 35 formed by the PVD process, no hot treatment is required such as the case in which the pastes are printed. Therefore, the individual electrodes 35 can be formed and patterned after the piezoelectric sheets 41 to 44 and the passage unit 4 are bonded, as described above. Therefore, handling the actuator unit 21 is very easy.

Moreover, according to this manufacture method, no consideration need be taken into the heat resisting temperature of the adhesive and the sintering temperature of the conductive paste, unlike the printing case done in the first manufacture method, thereby to wider, the range for selecting the materials for the adhesive and the conductive paste.

Here in this manufacture method, only the individual electrodes 35 are formed by the PVD. Unlike the common electrode 34 and the reinforcement metallic films 36*a* and 36*b*, more specifically, the individual electrodes 35 are not sintered together with the ceramics material to be the piezoelectric sheets 41 to 44. Therefore, the individual electrodes 35 exposed to the outside are hardly evaporated by the high-temperature heating at the sintering time. Moreover, the individual electrodes 35 can be formed to have a relatively small thickness by forming them by the PVD. Thus, the individual electrodes 35 in the uppermost layer are thinned in the ink-jet head 1 so that the displacement of the piezoelectric sheet 41 including the active layers is less regulated by the individual electrodes 35 thereby to improve the volume change of the pressure chambers 10 in the ink-jet head 1.

In this manufacture method, the individual electrodes 35 can be formed, for example, by plating them in place of the PVD. In this modification, the photoresist, not the metal mask 61, is applied to the piezoelectric sheet 41. After this, the marks 55 formed on the cavity plate 22 are optically recognized, and the photoresist in the region inside of the inner walls of the pressure chambers are irradiated with a light beam with reference to the positions of the recognized marks 55. After this, a developing liquid is used to remove the photoresist from the inside of the optically irradiated region. As a result, the photoresist has apertures in the same pattern as that of the metal mask 61. Here, the individual electrodes 35 may be formed in a pattern by the PVD by using the photoresist having the apertures as the mask. However, the use of the metal mask is more beneficial than the case of using the photoresist, because the reuse is possible and because the steps can be simplified. It is also possible to use a mask other than the metal mask and the photoresist for forming the individual electrodes and to use not only the positive type but also the negative type for the photoresist.

Figure 19A:
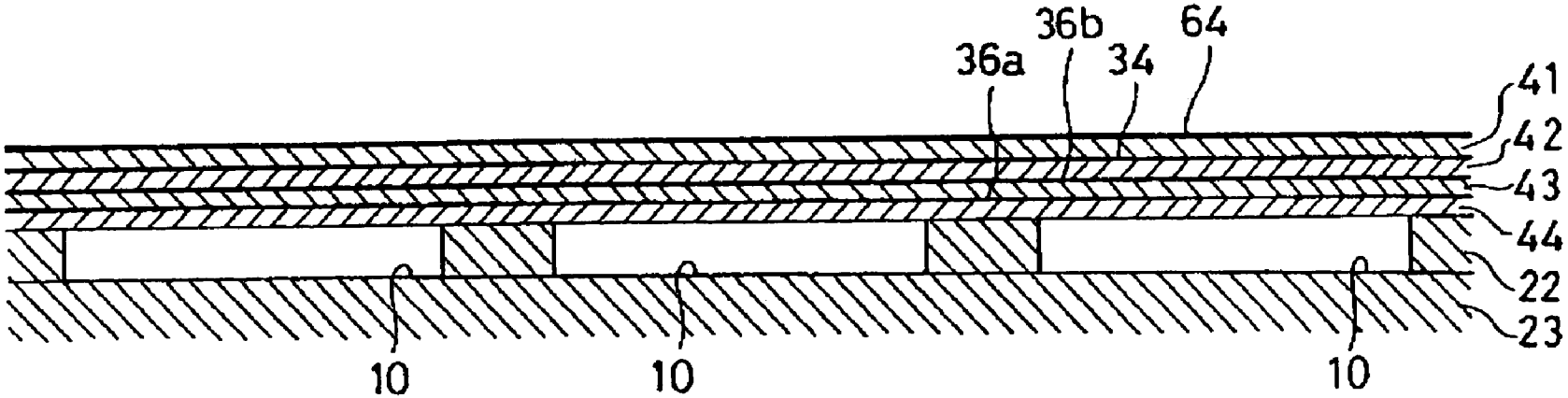
FIG. 19A and FIG. 19B are partial sectional views at individual steps in the course of the manufacture of the ink-jet head shown in FIG. 4 and based on a third manufacture method embodiment of the invention.
Figure 19B:
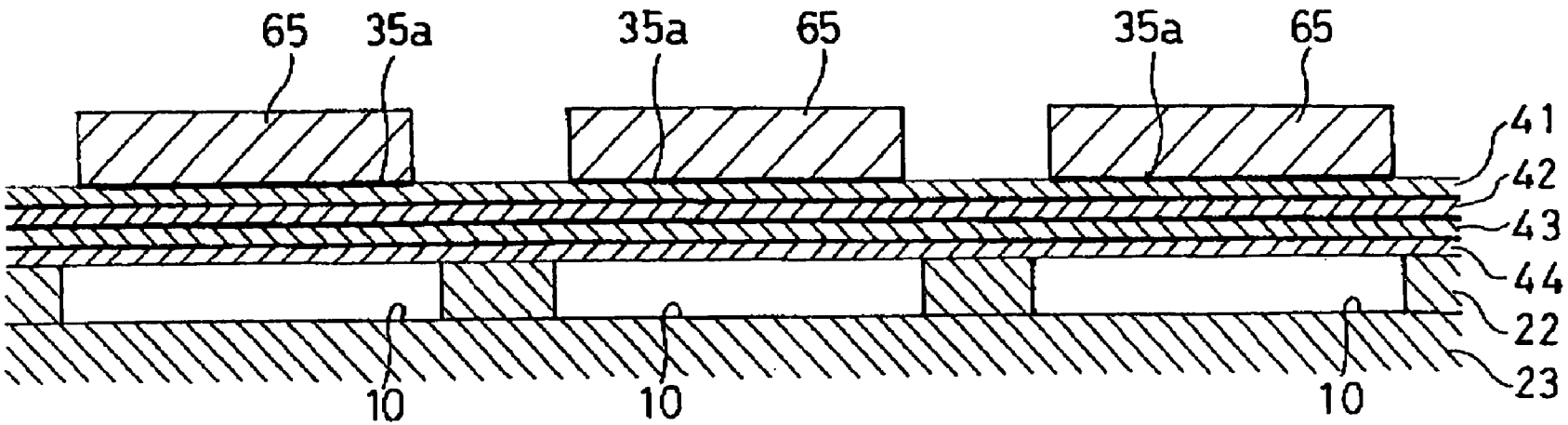
Figure 20:
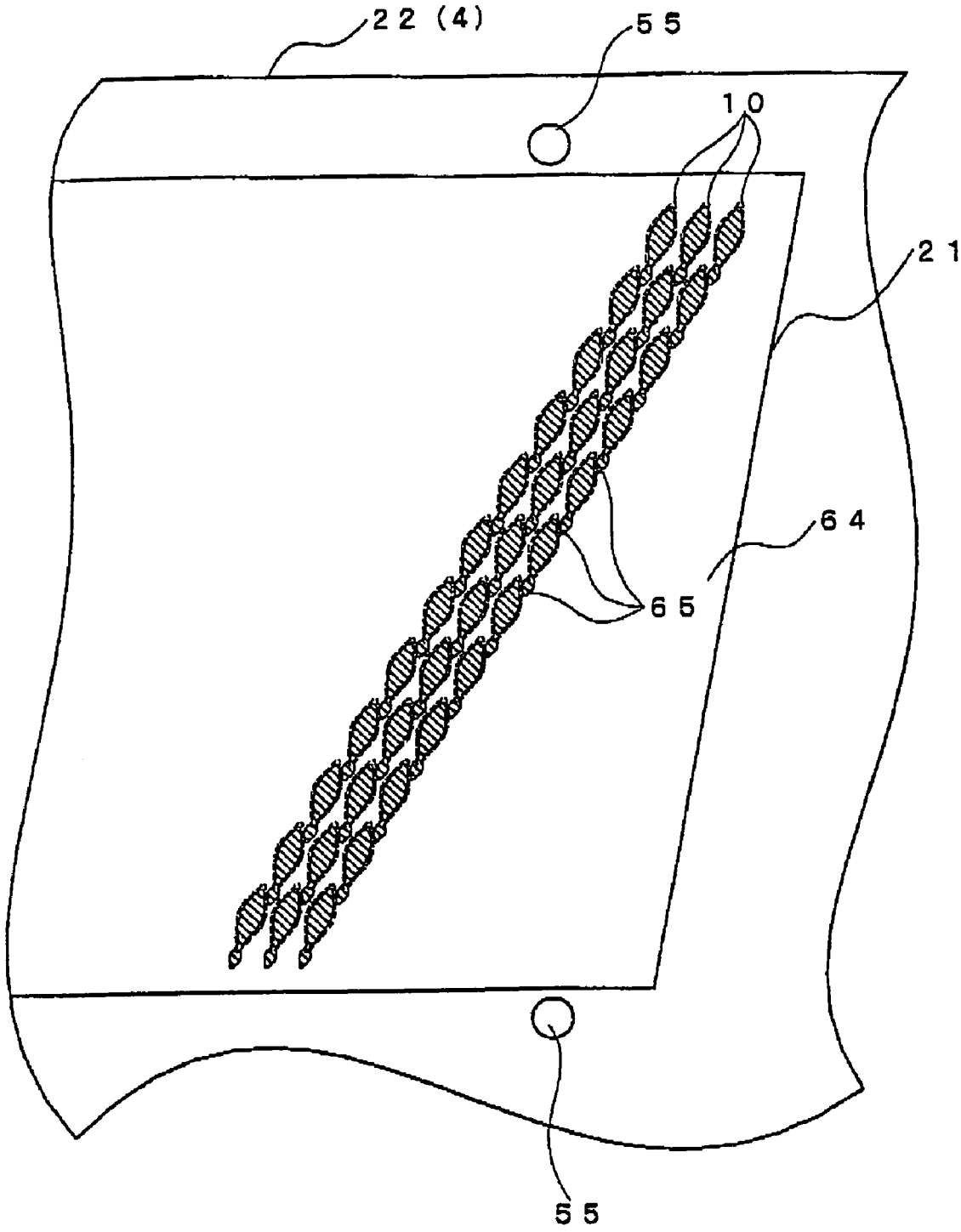
FIG. 20 is a plan view for explaining a region, in which a photoresist is arranged, at a step in the course of the manufacture of the ink-jet head shown in FIG. 4 and based on the third manufacture method embodiment of the invention.

Next, a third manufacture method of the ink-jet head 1 will be further described with reference to FIG. 19 and FIG. 20. Here, the steps up to the bonding step shown in FIG. 13A are identical so that their description will be omitted.

At first, from the bonded state shown in FIG. 13A, a conductive film 64 is formed by the PVD process all over the actuator unit 21 bonded to the passage unit 4. Here, the conductive film 64 may be formed by the CVD or plating process or by printing and sintering the paste in place of the PVD. Here, in case the paste is printed and sintered, it is necessary to consider the heat-resisting temperature of the adhesive, as described above. The sectional view corresponding to FIG. 11 of the ink-jet head at this time is presented in FIG. 19A.

Next, a positive type photoresist 65 is applied to the entire face the conductive film 64. After this, the marks 55 formed on the cavity plate 22 are optically recognized, and the photoresist 65 outside the region corresponding to rather inside of the inner walls of the pressure chambers 10 is irradiated with a light beam with reference to the positions of the marks 55 recognized. After this, a developing liquid is used, to remove the photoresist 65 from the inside of the optically irradiated region. As a result, the photoresist 65 is left as the pattern of the individual electrodes 35 only at the positions corresponding to the respective pressure chambers 10, as also shown in FIG. 20.

After this, the conductive film 64 is etched off from the region which is not covered with the photoresist 65, by using the left photoresist 65 as the etching mask. As a result, the individual electrodes 35 are formed in a pattern on the piezoelectric sheet 41. A sectional view of the ink-jet head at this time is presented in FIG. 19B.

After this, the remaining photoresist 65 is removed, and the FPC 136 for feeding the electric signals to the individual electrodes 35 is attached to the actuator unit 21. Thus, the manufacture of the ink-jet head 1 is completed through further predetermined steps.

Advantages similar to those of the first and second manufacture methods can also be obtained by this third manufacture method.

Next, a modification of the third manufacture method will be described. In this modification, at the step of laminating the piezoelectric sheets 41 to 44 when the actuator unit 21 is to be prepared, a conductive paste, which is to be the reinforcement metallic film 36*a*, is printed in a pattern on a green sheet of a ceramics material to be the piezoelectric sheet 44. In parallel with this, a conductive paste, which is to be the reinforcement metallic film 36*b*, is printed in a pattern on a green sheet of a ceramics material to be the piezoelectric sheet 43, and a conductive paste, which is to be the common electrode 34, is printed in a pattern on a green sheet of a ceramics material to be the piezoelectric sheet 42. Moreover, the conductive film 64 to be the individual electrodes 35 is Formed by the PVD or the plating process all over a green sheet of a ceramics material to be the piezoelectric sheet 41. Here, the conductive film need not be formed by the PVD or the plating process, but the conductive paste may be printed all over the face and may then be sintered.

After this, a layered structure is prepared by overlaying the four piezoelectric sheets 41 to 44 while positioning them with a Jig and is sintered at a predetermined temperature. As a result, there is formed the layered structure, which has the common electrode 34 formed on the lower face of the piezoelectric sheet 41 at the uppermost layer and the conductive film 64 formed on the upper face of the piezoelectric sheet 41. After this, the layered structure is bonded to the passage unit 4. A sectional view of the ink-jet head at this time, as corresponding to FIG. 11, is identical to FIG. 19A. After this, the ink-jet head 1 is completed through steps similar to those of the third manufacture method.

Advantages similar to those of the aforementioned first and second manufacture methods can also be obtained by this modification.

EMBODIMENT 2

Figure 21:
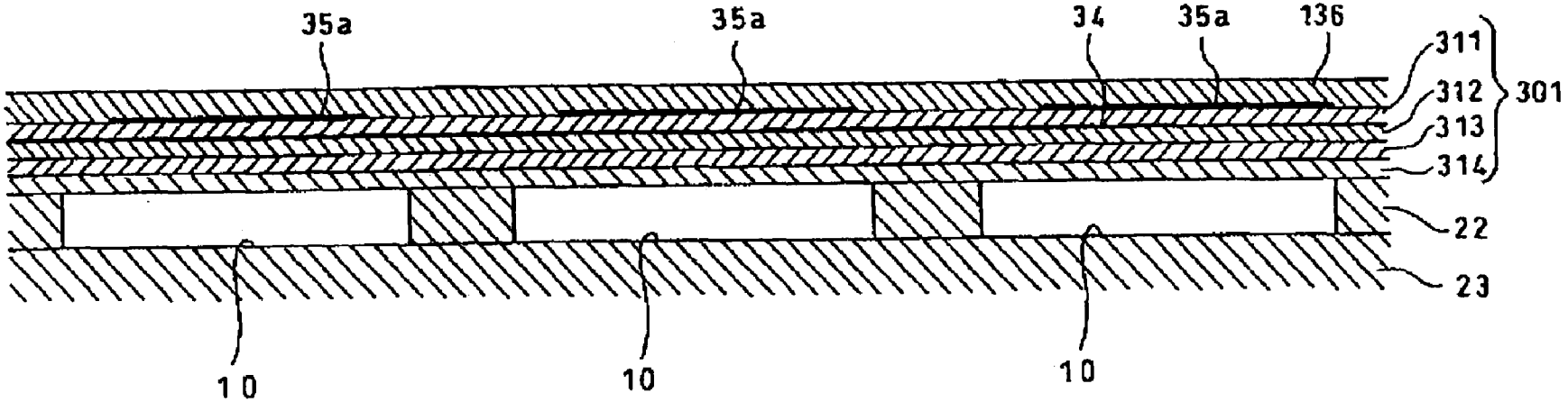
FIG. 21 is a partial sectional view of an ink-jet head main body according to a second embodiment of the invention.

Next, a second embodiment of the invention will be described hereinafter with reference to FIG. 21. FIG. 21 is a partial sectional view of an ink-jet head main body according to the second embodiment of the invention. This second embodiment, except for an actuator unit of the head main body shown in FIG. 21, is identical to the above-described first embodiment so that a description of the identical parts will be omitted. That is, the second embodiment differs from the first embodiment only in the actuator unit 301 of the head main body of the ink-jet head, and the other parts of the second embodiment is identical to those of the first embodiment. In FIG. 21, members similar to those described above will not be described by designating them by the common reference numerals.

The actuator unit 301 of the head main body according to the second embodiment is, as shown in FIG. 21, laminated with four piezoelectric sheets 311 to 314 each having the same thickness on an upper face of a cavity plate 22, and is provided with electrodes so that only the uppermost layer includes portions to be active only when an electric field is applied, and the remaining three layers are inactive. Similarly to the actuator unit 21 as described above, on the upper face of the uppermost piezoelectric sheet 311, individual electrodes 35 are formed for each of the pressure chambers 10. Each individual electrode 35 is composed of the main electrode portion 35*a* and a generally rhombic auxiliary electrode portion 35*b*. A projection image of the main electrode portion 35*a* projected along the thickness direction of the individual electrode 35 is included in the corresponding pressure chamber. The auxiliary electrode portion 35*b* is made smaller than the main electrode portion 35*a*. Between the piezoelectric sheet 311 and the piezoelectric sheet 312 downward adjacent to the piezoelectric sheet 311, a common electrode 34 is interposed formed on the entire face of the piezoelectric sheets. When the individual electrode 35 is set at a positive or negative predetermined potential, the portions as sandwiched between the individual electrodes 35 and the common electrode 34 act as active layers in the same manner as the above-described active layers.

The actuator unit 301 is not provided with the reinforcement metallic films 36*a* and 36*b* interposed between the piezoelectric sheets 43 and 44 and between the piezoelectric sheets 42 and 43, respectively, in the above-described actuator unit 21. That is, the piezoelectric sheets 313 and 314 prepared without printing in a pattern a conductive paste, which is to be the reinforcement metallic films, on green sheets of a ceramics material, which is to be the piezoelectric sheets 313 and 314, and the piezoelectric sheets 311 and 312 prepared similarly to the piezoelectric sheets 41 and 42 of the above-described actuator unit 21 are laminated to form the actuator unit 301.

Like this, since the reinforcement metallic films are not interposed between the piezoelectric sheets 313 and 314 and between the piezoelectric sheets 312 and 313 of the actuator unit 301, the actuator unit 301 internally holds only the common electrode, and therefore, the manufacturing process in preparing the actuator unit 301 can be simplified to facilitate manufacture of the ink-jet head. Moreover, the same advantages as described above can also be obtained in an ink-jet head in which the actuator unit 301 is applied to the head main body and an ink-jet printer using the ink-jet head.

EMBODIMENT 3

Figure 22:
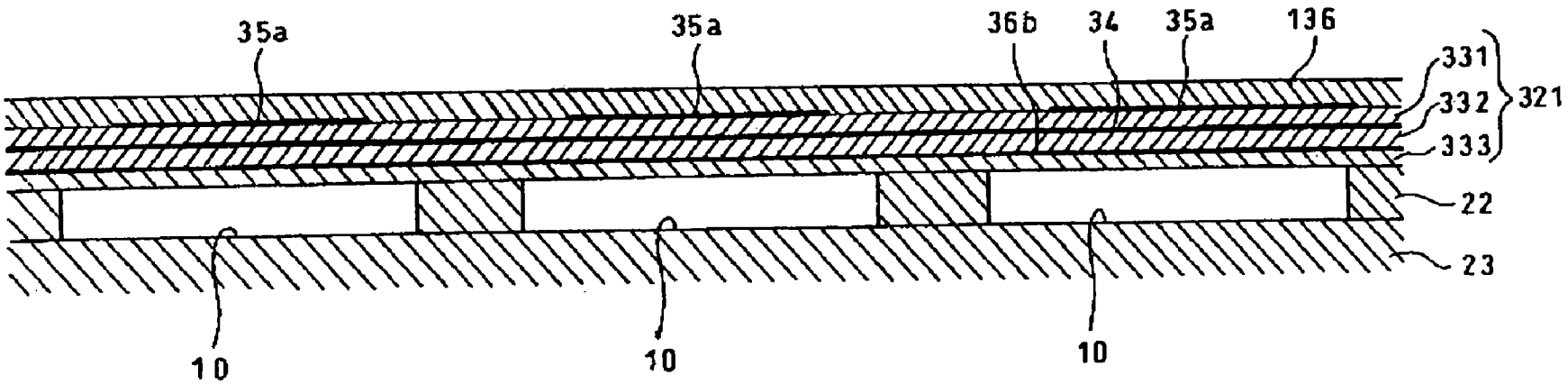
FIG. 22 is a partial sectional view of an ink-jet head main body according to a third embodiment of the invention.

Next, a third embodiment of the invention will be described hereinafter with reference to FIG. 22. FIG. 22 is a partial sectional view of an ink-jet head main body according to the third embodiment of the invention. This third embodiment, except for an actuator unit of the head main body shown in FIG. 22, is also identical to the above-described first embodiment so that a description of the identical parts will be omitted. That is, the third embodiment differs from the first embodiment only in the actuator unit 321 of the head main body of the ink-jet head, and the other parts of the third embodiment is identical to those of the first embodiment. In FIG. 22, members similar to those described above will not be described by designating them by the common reference numerals.

The actuator unit 321 of the head main body according to the third embodiment is, as shown in FIG. 22, laminated with three piezoelectric sheets 331 to 333 each having the same thickness on an upper face of a cavity plate 22, and is provided with electrodes so that only the uppermost layer includes portions to be active only when an electric field is applied, and the remaining two layers are inactive. Similarly to the actuator unit 21 as described above, on the upper face of the uppermost piezoelectric sheet 331, individual electrodes 35 are formed for each of the pressure chambers 10. Each individual electrode 35 is composed of the main electrode portion 35*a* and a generally rhombic auxiliary electrode portion 35*b*. A projection image of the main electrode portion 35*a* projected along the thickness direction of the individual electrode 35 is included in the corresponding pressure chamber. The auxiliary electrode portion 35*b* is made smaller than the main electrode portion 35*a*. Between the piezoelectric sheet 331 and the piezoelectric sheet 332 downward adjacent to the piezoelectric sheet 331, a common electrode 34 is interposed formed on the entire face of the piezoelectric sheets. When the individual electrode 35 is set at a positive or negative predetermined potential, the portions as sandwiched between the individual electrodes 35 and the common electrode 34 act as active layers in the same manner as the above-described active layers.

Since the actuator unit 321 has, except for the absence of the piezoelectric sheet 44 of the actuator unit 21, the same structure as that of the above-described actuator unit 21, the reinforcement metallic films 36*a* interposed between the piezoelectric sheets 43 and 44 is not interposed. Thus, the manufacturing process in preparing the actuator unit 321 can be simplified to facilitate manufacture of the ink-jet head. Moreover, the same advantages as described above can also be obtained in an ink-jet head in which the actuator unit 321 is applied to the head main body, and an ink-jet printer using the ink-jet head.

EMBODIMENT 4

Figure 23:
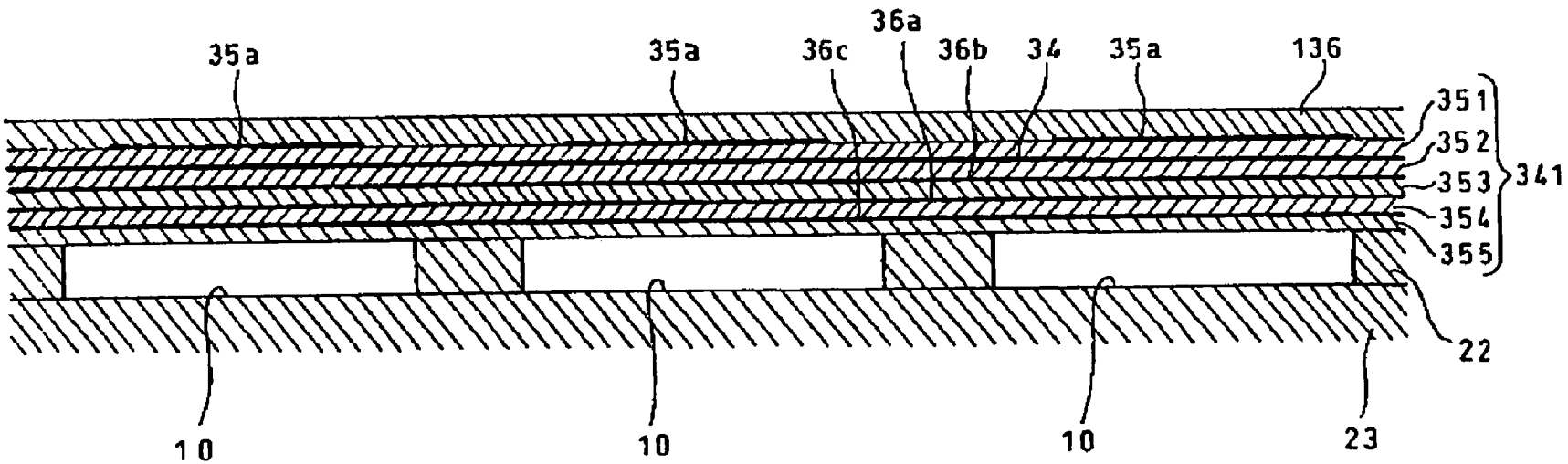
FIG. 23 is a partial sectional view of an ink-jet head main body according to a fourth embodiment of the invention.

Next, a fourth embodiment of the invention will be described hereinafter with reference to FIG. 23. FIG. 23 is a partial sectional view of an ink-jet head main body according to the fourth embodiment of the invention. This fourth embodiment, except for an actuator unit of the head main body shown in FIG. 23, is also identical to the above-described first embodiment so that a description of the identical parts will be omitted. That is, the fourth embodiment differs from the first embodiment only in the actuator unit 341 of the head main body of the ink-jet head, and the other parts of the fourth embodiment is identical to those of the first embodiment. In FIG. 23, members similar to those described above will not be described by designating them by the common reference numerals.

The actuator unit 341 of the head main body according to the fourth embodiment is, as shown in FIG. 23, laminated with five piezoelectric sheets 351 to 355 each having the same thickness on an upper face of a cavity plate 22, and is provided with electrodes so that only the uppermost layer includes portions to be active only when an electric field is applied, and the remaining four layers are inactive. Similarly to the actuator unit 21 as described above, on the upper face of the uppermost piezoelectric sheet 351, individual electrodes 35 are formed for each of the pressure chambers 10. Each individual electrode 35 is composed of the main electrode portion 35*a* and a generally rhombic auxiliary electrode portion 35*b*, A projection image of the main electrode portion 35*a* projected along the thickness direction of the individual electrode 35 is included in the corresponding pressure chamber. The auxiliary electrode portion 35*b* is made smaller than the main electrode portion 35*a*. Between the piezoelectric sheet 351 and the piezoelectric sheet 352 downward adjacent to the piezoelectric sheet 351, a common electrode 34 is interposed formed on the entire face of the piezoelectric sheets. When the individual electrode 35 is set at a positive or negative predetermined potential, the portions as sandwiched between the individual electrodes 35 and the common electrode 34 act as active layers in the same manner as the above-described active layers.

The actuator unit 341 is the same as the above-described actuator unit 21 except that a piezoelectric sheet similar to the piezoelectric sheet 44 is further provided on a lower face of the piezoelectric sheet 44, and a reinforcement metallic film is provided between that piezoelectric sheet and the piezoelectric sheets 44. That is, a piezoelectric sheet 353 is disposed below a piezoelectric sheet 352, and a piezoelectric sheet 354 is disposed below the piezoelectric sheet 353, and further a piezoelectric sheet 355 is also disposed below the piezoelectric sheet 354, so as to constitute the actuator unit 341. Reinforcement metallic films 36*a* and 36*b* are interposed between the piezoelectric sheets 353 and 354 and between the piezoelectric sheets 352 and 353, respectively, and further, a similar reinforcement metallic film 36*c* is also interposed between the piezoelectric sheets 354 and 355.

Like this, since the actuator unit 341 is constituted with the five piezoelectric sheets 351 to 355, the piezoelectric sheet 351 including the active layers and the four piezoelectric sheets 352 to 355 including the inactive layers can be largely deformed in the thickness direction, and change in volume of each pressure chamber can thereby be relatively increased. Thus, it is possible to lower a drive voltage of the individual electrodes and to reduce a size and raise the density of the pressure chambers. Moreover, the same advantages as described above can also be obtained in an ink-jet head in which the actuator unit 341 is applied to the head main body, and an ink-jet printer using the ink-jet head.

EMBODIMENT 5

Figure 24:
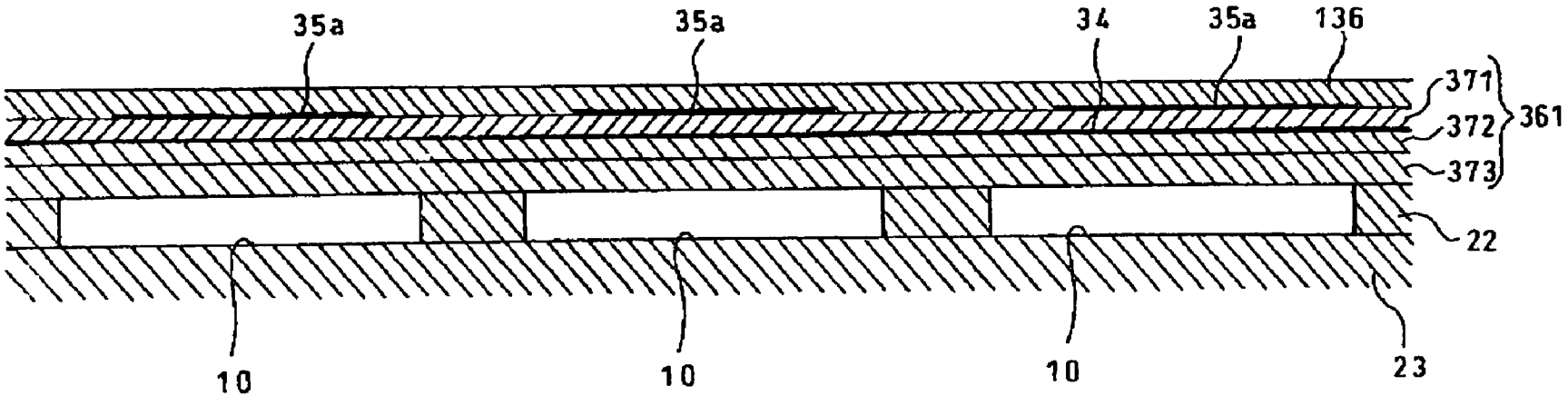
FIG. 24 is a partial sectional view of an ink-jet head main body according to a fifth embodiment of the invention.

Next, a fifth embodiment of the invention will be described hereinafter with reference to FIG. 24. FIG. 24 is a partial sectional view of an ink-jet head main body according to the fifth embodiment of the invention. This fifth embodiment, except for an actuator unit of the head main body shown in FIG. 24, is also identical to the above-described first embodiment so that a description of the identical parts will be omitted. That is, the fifth embodiment differs from the first embodiment only in the actuator unit 361 of the head main body of the ink-jet head, and the other parts of the fourth embodiment is identical to those of the first embodiment. In FIG. 24, members similar to those described above will not be described by designating them by the common reference numerals.

The actuator unit 361 of the head main body according to the fifth embodiment is, as shown in FIG. 24, laminated with three piezoelectric sheets 371 to 373 or an upper face of a cavity plate 22, and is provided with electrodes so that only the uppermost layer includes portions to be active only when an electric field is applied, and the remaining two layers are inactive. Similarly to the actuator unit 21 as described above, on the upper face of the uppermost piezoelectric sheet 371, individual electrodes 35 are formed for each of the pressure chambers 10. Each individual electrode 35 is composed of the main electrode portion 35*a* and a generally rhombic auxiliary electrode portion 35*b*. A projection image of the main electrode portion 35*a* projected along the thickness direction of the individual electrode 35 is included in the corresponding pressure chamber. The auxiliary electrode portion 35*b* is made smaller than the main electrode portion 35*a*. Between the piezoelectric sheet 371 and the piezoelectric sheet 372 downward adjacent to the piezoelectric sheet 371, a common electrode 34 is interposed formed on the entire face of the piezoelectric sheets. When the individual electrode 35 is set at a positive or negative predetermined potential, the portions as sandwiched between the individual electrodes 35 and the common electrode 34 act as active layers in the same manner as the above-described active layers.

The actuator unit 361 is the same as the above-described actuator unit 21 except that the piezoelectric sheet 44 is not provided, the piezoelectric sheet 43 is formed thicker, and the reinforcement metallic films 36*a* and 36*b* disposed between the piezoelectric sheets 43 and 44 and between the piezoelectric sheets 42 and 43, respectively, are not interposed. That is, the piezoelectric sheet 373 laminated below the piezoelectric sheet 372 is formed thicker than the piezoelectric sheets 371 and 372 to constitute the actuator unit 361 having a sufficient strength. Thus, since the reinforcement metallic film need not be formed between the piezoelectric sheets 372 and 373, the manufacturing process in preparing the actuator unit 361 can be simplified to facilitate manufacture of the ink-jet head. Moreover, the same advantages as described above can also be obtained in an ink-jet head in which the actuator unit 361 is applied to the head main body, and an ink-jet printer using the ink-jet head.

Ink-jet heads each having the actuator units 301, 321, 341, and 361 according to the above-described second to fifth embodiments can also be manufactured by the same method as the method for manufacturing the above-described ink-jet head 1. Also, each piezoelectric sheet is formed of the same material as that of the piezoelectric sheets in the above-described actuator unit 21.

Although the preferred embodiments of the present invention have been described above, the present invention is never limited to the above-described embodiments. So far as the claims mention, various changes in design can be made. For example, the materials used in the aforementioned embodiments for the piezoelectric sheets and the electrodes should not be limited to the aforementioned ones but may be modified into other well-known materials. Moreover, the plan shapes, sectional shapes and arrangements of the pressure chambers, the number of piezoelectric sheets including the active layers, and the number of the inactive layers may also be suitably modified.

In the aforementioned embodiments, moreover, the actuator unit is formed by arranging the individual electrodes and the common electrode on the piezoelectric sheet. However, this actuator unit need not always be bonded to the passage unit but can also be exemplified by another if it can change the volumes of the pressure chambers individually. Moreover, the foregoing embodiments have been described on the structure in which the pressure chambers are arranged in a matrix. However, the invention can also be applied to the structure in which the pressure chambers are arrayed in one or a plurality of rows.

In the foregoing embodiments, the active layers are formed only in the uppermost piezoelectric sheet that is the most distant sheet from the pressure chamber. However, the uppermost piezoelectric sheet may not always contain the active layers, but the active layers may also be formed in another piezoelectric sheet in addition to the uppermost one. In these modifications, it is possible to acquire a sufficient crosstalk suppressing effect. Moreover, the ink-jet head of the aforementioned embodiments has the unimorph structure utilizing the transversal piezoelectric effect. However, the invention can also be applied to the ink-jet head which has a layer including active layers arranged closer to the pressure chamber than the inactive layer and utilizes the longitudinal piezoelectric effect.

The apertures and marks are formed in the individual plates constructing the passage unit by the etching process. However, these apertures and marks may also be formed in the individual plates by a process other than the etching process.

In the foregoing embodiments, all the inactive layers are the piezoelectric sheets, but the inactive layers may be exemplified by insulating sheets other than the piezoelectric sheets. Moreover, the actuator unit need not be arranged continuously across a plurality of pressure chambers. In other words, independent actuator units of the number of pressure chambers may also be adhered to the passage units.

In the invention, moreover, the member containing the piezoelectric sheet may contain only one piezoelectric sheet having the active layers, each of them being sandwiched between the common electrode and the individual electrode, as in the foregoing embodiments, or may contain not only one or more piezoelectric sheets having the active layers but also a plurality of sheet members as the inactive layers laminated on the piezoelectric sheet or sheets.

The invention claimed is:

1. An ink-jet head comprising:

a passage unit including a plurality of pressure chambers each having one end coupled to a nozzle and the other end to be coupled to an ink supply source, the plurality of pressure chambers being arranged along a plane adjacent to each other; and a plurality of actuator units attached to a surface of the passage unit for changing volume of the pressure chambers, wherein an actuator unit of the actuator units includes:

a common electrode kept at a constant potential;

individual electrodes disposed at positions respectively corresponding to each of the pressure chambers, the individual electrodes being formed only on a face of the actuator unit opposite to a face attached to the passage unit;

a piezoelectric sheet sandwiched between the common electrode and the individual electrodes; and an inactive layer having a thickness larger than that of the piezoelectric sheet and sandwiched between the common electrode and the passage unit.

2. The ink-jet head according to claim 1, wherein the inactive layer comprises a lamination of a plurality of insulating sheets.

3. The ink-jet head according to claim 2, wherein the plurality of insulating sheets have substantially a same thickness.

4. The ink-jet head according to claim 3, wherein the inactive layer comprises a lamination of three insulating sheets.

5. The ink-jet head according to claim 1, wherein the inactive layer is formed of one or more piezoelectric sheets.

6. The ink-jet head according to claim 1, wherein the actuator unit internally holds only the common electrode, among the common electrode and the individual electrodes.

7. The ink-jet head according to claim 1, wherein the actuator unit is arranged across the plurality of pressure chambers.

8. The ink-jet head according to claim 1, wherein the common electrode is kept at a ground potential.

9. The ink-jet head according to claim 1, wherein the common electrode is arranged in such a manner as to substantially cover an entire face of the piezoelectric sheet.

10. An ink-jet printer including the ink-jet head according to claim 1.

* * * * *